United States Patent [19]

Tompkins et al.

[11] Patent Number: 4,931,839

[45] Date of Patent: Jun. 5, 1990

[54] TRANSFER SYSTEM FOR ELECTROPHOTOGRAPHIC PRINT ENGINE

[75] Inventors: E. Neal Tompkins, Atlanta; Jack N. Bartholmae, Duluth; Peter A. Zuber, Norcross; Kirk W. Charles, Atlanta, all of Ga.

[73] Assignee: Colorocs Corporation, Norcross, Ga.

[21] Appl. No.: 166,674

[22] Filed: Mar. 11, 1988

[51] Int. Cl.[5] ..... G03G 15/14; G03G 15/01

[52] U.S. Cl. ..... 355/277; 355/271; 355/273; 355/327; 430/45; 430/109

[58] Field of Search ..... 355/3 TR, 3 BE, 14 TR, 355/16, 271, 273, 274, 327, 328, 277; 430/45, 47, 109

[56] References Cited

U.S. PATENT DOCUMENTS

| | | | |
|---|---|---|---|
| 3,697,170 | 10/1972 | Bhagat et al. | 355/16 X |
| 3,729,311 | 4/1973 | Langdon | 355/14 TR X |
| 3,776,627 | 12/1973 | Onishi | 355/211 |
| 3,963,341 | 6/1976 | Tully | 355/4 |
| 3,976,370 | 8/1976 | Goel et al. | 355/3 TR |
| 3,992,557 | 11/1976 | Kubo et al. | 430/126 |
| 4,093,457 | 6/1978 | Hauser et al. | 355/327 X |
| 4,183,658 | 1/1980 | Winthaegen | 355/3 BE |
| 4,275,103 | 6/1981 | Tsubushaki et al. | 428/148 |
| 4,431,301 | 2/1984 | Hashimoto et al. | 355/3 TR X |
| 4,468,113 | 8/1984 | Motohashi et al. | 355/14 TR |
| 4,541,709 | 9/1985 | Kampschreur | 355/3 TR |
| 4,588,279 | 5/1986 | Fukuchi et al. | 355/3 TR |
| 4,708,460 | 11/1987 | Langdon | 355/3 TR X |
| 4,809,038 | 2/1989 | Yamamoto et al. | 355/327 |

*Primary Examiner*—Fred L. Braun

*Attorney, Agent, or Firm*—Jones, Askew & Lunsford

[57] ABSTRACT

A transfer mechanism for a full color double transfer electrophotographic print engine. Relatively conductive developer materials having successively increasing triboelectric charge characteristics are used to develop sequential images. Conductive plates displaced away from the transfer station along the direction of travel of the transfer belt are used as one electrode for applying an electrostatic field at each transfer station. A parameter of the transfer mechanism is a bulk resistivity of the transfer belt in the range of $10^7$ to $10^{10}$ ohm-centimeters and a surface resistivity for the belt in the range of $10^7$ to $10^{10}$ ohms per square. A selectively operable compression roller, compressing paper and transfer belt against a rubberized idling roller at one of the transfer stations increase dwell time in the transfer station. The compression roller automatically falls to a cleaning station where it is rotated by another rotary member to clean it between transfers. The use of conductive developer materials also tends to eliminate halo problems common in color electrophotography.

45 Claims, 5 Drawing Sheets

TRANSFER SYSTEM FOR ELECTROPHOTOGRAPHIC PRINT ENGINE

TECHNICAL FIELD

The present invention relates to toner transfer mechanisms in electrophotographic print engines and particularly comprises several improvements to mechanisms for transferring toner in subtractive color electrophotographic printing systems, both of the single transfer and double transfer types.

BACKGROUND OF THE INVENTION

In the almost 50 years since its invention, many improvements have taken place in electrophotographic print engines. In particular, dry printing or xerographic printing machines used in copiers have become a stable and necessary element of modern business life in the industrialized world. More recently, full color electrophotographic print engines have been produced and are becoming more popular as their price drops as compared to monochromatic machines.

Still more recently, the use of electrophotographic print engines in laser printing devices is becoming a common staple of many office environments because of the very high quality images produced thereby and their versatility with respect to type fonts, graphic reproductions, and the like.

A machine embodying significant steps in size and cost reduction for a full color electrophotographic print engine, usable in a copying machine, laser printer, or other image producing apparatus requiring full color electrophotography, is disclosed in U.S. Pat. No. 4,652,115 to Palm et al. issued Mar. 24, 1987. U.S. Pat. No. 4,652,115 is assigned to the assignee of the present invention. The Palm '115 patent disclosed what its inventors believed to be the first practical full color electrophotographic print engine employing flexible belts rather than drums as a carrier for the engine's photoreceptor. Additionally, the Palm '115 patent discloses a practical belt oriented full color double transfer electrophotographic print engine.

The toner transfer mechanism in the machine disclosed in the Palm '115 patent uses conventional coronas which are devices which have been used for many years in electrophotographic print engines for establishing high electrostatic fields for toner transfer and toner adhesion. As is well known to those skilled in the art, coronas are useful for creation of high electrostatic fields but their performance, particularly with respect to the fields created by a corona with a given input voltage and current, are greatly affected by ambient conditions of air temperature and humidity.

Thus, it is known that use of other devices to create electrostatic fields for toner transfer helps overcome perturbations in corona performance as a result of environmental parameters.

One such mechanism is the direct application of an electric field between a surface carrying a developed toner image and a surface to which the images to be transferred by means of application of a constant voltage between the mechanical devices (usually drums) carrying the two respective surfaces. An electrophotographic print engine employing such a mechanism is shown, for example, in U.S. Pat. No. 3,729,311 to Langdon.

Traditionally, relatively high source voltages are used in the transfer of toner material in electrophotographic print engines, particularly color engines in which transfers for a multiple layers of toner material must be made. For example, Langdon teaches transfer from photoreceptor carrying drum to paper carrying drum using an applied field of between 3,000 and 4,000 volts. Although the applied field is a relatively high voltage, the actual voltage across the paper is much less because there is a large voltage drop in the air between the corona and the paper carrying drum.

As is known to those skilled in the art, the danger of increasing applied transfer voltage in order to increase transfer efficiency comes from the phenomenon of electrical breakdown between the photoreceptor and image receiving web, which term includes an ultimate print receptor such as paper or a sheet of transparent material, or an intermediate transfer belt as in the case of the preferred embodiment of the present invention. Electrical breakdown arises when the electric field intensity at various points along the photoreceptor/image receiving web interface reaches a sufficient strength to ionize the material lying there between, usually gases in the air. Once a path of ionized gas is established, the electrical resistance between two points at the extremes of potential of the electric field becomes very low and available current will rush through the path of the breakdown.

Naturally, electric field intensities get very high at the photoreceptor to image receiving web interface in an electrophotographic print engine in which an applied field of several thousand volts is placed across a very narrow gap between these two surfaces.

As is known to those skilled in the art, selection of surface resistivity or conductivity of a surface at such an interface in a high electric field affects the total current which flows through breakdown paths. Once an ionized breakdown path is established, the total current flowing through the path will be determined by the surface resistivity of the material lying at the relative negative potential of the applied field, since this is the source of electrons. If the material in question has a low surface resistivity, there are a large number of electrons available and a high current will flow through the discharge path, possibly causing significant damage as it does so.

It is known to those skilled in the art that the total current through any given breakdown path will determine the destructive impact of the flow through the breakdown. Examples from everyday life illustrate this phenomenon. On the one hand, consider the commonly encountered spark from the human hand to a grounded metal surface (often a door knob) which one experiences when walking across a rug or similar surface which will induce a triboelectrical charge in the body.

Thus, the conventional wisdom has taught the use of insulating materials for construction of photoreceptors in electrophotographic print engines. Known belt constructions include those with relatively low resistivities covered by a highly resistive layer of material having a high dielectric constant. In either instance, the principle behind use of such a device is to severely limit the current available to flow through any given breakdown path. Breakdown and electronic discharge through toner materials in electrophotographic print engine are believed to cause small spots or flecks in areas where toner is removed due to the phenomenon of multiple small explosions around the breakdown. If sufficient current is available, the electrical discharge which results from the breakdown can damage the photoreceptor belt. This can be either a macro phenomenon in which there is physical damage to the belt or a micro phenomenon in which portions of the photoreceptor material are destroyed. The cumulative effect of large numbers of breakdowns ultimately degrade photoreceptor performance to an unacceptable level.

Therefore, the prior art shows use of highly insulative materials for photoreceptors and backing media on ultimate image receptors to limit current which flows through discharge paths.

It is the surface resistivity characteristic, normally specified in ohms or ohms per square, which primarily impacts the above described available current in the event of a discharge. It is also a very high surface resistivity which tends to cause the accumulation of local charge maxima.

Although it turns out that the magnitudes of the preferred ranges for both surface resistivity and bulk resistivity on the transfer belt used in the preferred embodiment are substantially identical, this is a coincidence. It is known that one can engineer belt and drum materials in a fashion in which the numerical value of the bulk resistivity (given in ohm centimeters) substantially differs from that of the surface resistivity (specified in ohms).

There is a countervailing consideration which results from the use of materials of very high surface resistivity for these applications. The problem which results from the use of materials of high resistivity is that areas of very high charge will accumulate locally on the surface of such a material and will not dissipate, or spread out evenly over the surface of the photoreceptor, because of its very low conductivity. Increasing the conductivity of the material allows these local maxima of charge to dissipate and thus provides a much more uniform charge per unit area characteristic to be established.

Additional problems are presented in full color electrophotographic print engines in which multiple toners are used to build up a composite image which is ultimately fixed to the image receptor. One problem which is known arises from the effects of previously deposited layers of toner on the transfer of the second and third toners to be laid down in forming a composite image. It is well known that toners are normally plastic particles having specified triboelectric charge characteristics, which characteristics have the dimensions of charge per unit mass. The toner or developer particles are physically agitated and accumulate triboelectric charge thereon of a specific polarity. Also, it is well known that toner materials can be manufactured to specified average triboelectric charge characteristics, which are normally stated in microcoulombs per gram. Thus, after sufficient agitation, the average triboelectric charge present within a collection of toner material will be a certain number of microcoulombs per gram.

It is known in the art that judicious selection of average triboelectric charge characteristics for toner materials can contribute significantly to overall print engine performance, whether in a copier, laser printer, or other device employing such a print engine. The parameters impacted by triboelectric charge are primarily development density, i.e. the efficiency in properly developing latent electrostatic images with toner materials, and transfer from the original photoreceptor to the ultimate image receptor used in the machine. The latter may be accomplished by directly transferring the image onto the ultimate print receptor, normally a sheet of paper, or through the use of an intermediate transfer drum or belt, as is disclosed in the preferred embodiment of the present invention.

Additionally, triboelectric charge for toner materials impacts a phenomenon known as back transfer in multipass electrophotographic print engines. The phenomenon of back transfer refers to any tendency of toner materials (deposited on an image receiving web during a previous transfer of a developed separated image) to move back to the image carrying web from which such materials were originally transferred during transfer of a subsequent collection of different toner particles. In other words, if a first separated image is developed on a photoreceptor and transferred to a sheet of paper, the phenomenon of back transfer refers to the tendency of the first toner materials on the paper to transfer back to the photoreceptor as a second developed separated image is being transferred to the paper.

Naturally, there is a significant and intimate interplay between applied fields and toner triboelectric charge characteristics which ultimately determines the quality of a final printed image in an electrophotographic print engine.

The selection of appropriate triboelectric charge characteristics for toner materials becomes much more critical in full color copying machines than is the case for monochromatic machines for the following reasons. First, multiple toners (usually three) are used in full color copiers and printers and thus there is the opportunity for significant interaction between the various toner materials used to develop the individual separated images. Secondly, there is a significant factor with respect to the perceived quality of the ultimate output of the print engine because of their normal uses. A color print engine is required to develop a set of ultimate images of a much broader range than one normally encounters in the use of monochromatic machines, particularly those used primarily to reproduce text in an office environment. There is a significant dynamic range with respect to color saturation, and a significant range of the spectrum which such machines are required to reproduce. Also, the perceived quality of the output of a full color print engine is greatly diminished by spectral inaccuracy and inappropriate pigment separations, particularly at image boundaries or in dark areas of the output produced by significant densities of all three toners.

In the first category, problems with respect to separated image registration in forming the final composite image can create significant problems with respect to the perceived quality of the output. Registration problems normally manifest themselves on edges of the image where individual pigments are reproduced along the boundary where a composite image of essentially uniform color is what is represented by the source of image information driving the print engine.

Additionally, the well known phenomenon of halo severely deteriorates the perceived quality of the ultimate image in a color machine, whereas the effect is of marginal significance in a monochrome print engine. In a color print engine, halo manifests itself as inconsistent pigment mixing at a boundary in an image even if registration of the separated images to form the composite image is done with virtual perfection. The visual effect is similar to that caused by misregistration. However, halo will normally appear as a consistent border of inappropriate pigmentation surrounding an entire image segment, whereas registration problems normally manifest themselves as visible shifts in the pigments from the separated images in a particular direction.

It is known in the art that certain undesirable effects in color electrophotographic print engines may be overcome, or offset, by selection of triboelectric charge characteristics of the toner materials. In particular, U.S. Pat. No. 4,093,547 to Hauser et al. discloses a color electrophotographic print engine in which stepped triboelectric charge characteristics for the three color toners are used in order to minimize the phenomenon of back transfer. Hauser discloses a single transfer color electrophotographic print engine in the environment of a copying machine. The images are developed using yellow, cyan, and magenta toner materials, respectively.

Hauser teaches a wide and decreasing sequential range of triboelectric charge characteristics for the three toner materials. In particular, he teaches a preferred embodiment of 44 microcoulombs per gram for the first toner (yellow), 20 microcoulombs per gram for the second toner (cyan) and 6 microcoulombs per gram for the third (magenta) toner.

The principle of operation of this machine is as follows. Charged areas of the photoreceptor which develop each separated image naturally attract the toner materials in use, which is how the latent image is turned into a developed image in the first place. Once a first layer of toner materials has been transferred from the photoreceptor, a subsequent pass to the photoreceptor will contain charged areas where the second image is developed. While an applied field is used to transfer toner materials in the desired direction, there is a significant electric field contribution from the charged areas of the photoreceptor which tends to draw the previously transferred particles back to the photoreceptor. This is particularly true at boundaries between pigmented areas where, for example, there may be a toner material of the first color already transferred to the paper and an absence of toner of the second color on one side of the boundary. The charged area of the photoreceptor near the boundary will tend to draw the previously transferred particles back to the photoreceptor, which lowers the density of the previously transferred separated image of the first pigment and may corrupt the composite image.

Next consider the situation when the second layer of toner has been transferred and a developed image with the third toner material is approaching the transfer station. First, areas of the composite image which contain both the first and second pigments will be closer to the photoreceptor, and thus the photoreceptor's pull on the top layer (the second toner material) will be stronger than the like attraction to the first pigment toner during the previous transfer. Similarly, it is believed that as the third layer is transferred, boundaries between charged and uncharged portions of the photoreceptor which are substantially perpendicular to the direction of travel of the photoreceptor can also tend to pull portions of the last deposited toner material back to the photoreceptor.

It is the teaching of Hauser that successively decreasing the triboelectric charge characteristics of the toner materials reduces the attraction between the photoreceptor and the later deposited materials having the lower charge.

For reasons set forth hereinbelow, the inventors of the present invention believe they have discovered that Hauser's approach is exactly the opposite of the optimum use of stepped triboelectric charge characteristics for toner materials. Therefore, one aspect of the present invention involves the use of stepped triboelectric charge characteristics from materials in the opposite order of that taught in Hauser, i.e. the last toner material to be transferred is the one of the highest triboelectric charge.

Also related to the problem of back transfer is the problem of non-uniform forward transfer. Often it is quite difficult for the designer or operator of an electrophotographic print engine to ascertain which phenomenon is causing problems in the quality of the printed output. In other words, if the toner materials never leave the photoreceptor in the first place, it normally makes little difference in the ultimate print quality whether they simply failed to leave when they were supposed to be transferred, or were transferred initially and back transferred to the photoreceptor on a subsequent pass. Thus, minimizing the phenomenon of back transfer as well as attempting to assure uniformity of forward transfer are important design goals for color electrophotographic print engines.

In this respect, the following should be noted. One way of approaching the problems is to postulate that the best transfer which takes place in a color electrophotographic print engine is that of the first toner material transferred from the photoreceptor to an image receiving web, either the final image receptor or an intermediate transfer web. This is because it is relatively straightforward to provide a uniform surface charge characteristic on the image receiving web when the first developed separated image is to be transferred thereto. Subsequent transfers of the second and third images encounter perturbations in the surface electric field characteristics caused by the already present toner materials from previously transferred images.

One good approach to overcoming the perturbations due to previously transferred toner materials is disclosed in U.S. Pat. No. 3,992,557 to Kubo et al. The Kubo apparatus uses a plurality of additional coronas to precharge the image receiving web so as to overcome perturbations in the surface charge characteristics of the web as a developed image approaches the transfer station. It should be noted that, in this context, the surface charge characteristics of the web include the contributions from previously transferred toner materials.

A primary drawback of the Kubo approach is expense, i.e. the use of several additional coronas, and the consequent environmental instability which comes from any device relying strongly on coronas to establish desired electrostatic fields.

U.S. Pat. No. 3,729,311 to Langdon (cited above) shows another useful method of assisting in uniformity of forward transfer characteristics in a full color electrophotographic print engine. Langdon discloses the use of a conductive backing for a drum carrying a sheet of paper (or other image receptor) and postulates that degradation in forward transfer results from an increased composite resistivity of the toner receiving surface (the paper and previously transferred toner layers) during transfer of second and third toner images. He further states that increasing the fixed bias between photoreceptor and the backing for the print receptor was an unsuccessful experiment, indicating that it was believed that breakdown phenomena prevented transfer of the images in question.

In order to overcome this, Langdon teaches the use of a stepped applied field as subsequent toner layers are transferred to build up the composite image. In particular, Langdon teaches a preferred range of 3,000, 3,500 and 4,000 volts as the applied field for three successive transfers of three toner materials. The preferred embodiment of the present invention also makes use of the principle of stepped applied fields during toner transfer.

As noted above, the phenomenon of halo is an unintentional and inappropriate color separation at image boundaries which is encountered in full color electrophotographic print engines. It is the belief of the inventors of the present invention that the phenomenon of halo has become so problematic in prior art color electrophotographic print engines because of an inappropriate application of certain accepted design principles applicable to monochromatic print engines to color print engines. In particular, it is the present inventors' belief that persistent use of toner materials of high bulk resistivity and high triboelectric charge exacerbates the problem of halo in a color print engine.

It is known to those skilled in the art of electrophotography that the use of high resistivity toner materials (usually having resistivities greater than $10^{10}$ ohm centimeters) enhances edge definition in monochromatic print engines but tends to deteriorate to some degree the fill characteristics of large densely decorated areas. This phenomenon is well known to users of monochromatic print engines wherein large black areas will often run to various shades of gray when the saturation of the original image was uniform. However, edge enhancement is achieved because highly resistive developer materials tend to accumulate small excesses of the materials at the boundaries. This tends to cause dense deposits of toner near the boundaries between black and white portions of the image and thus increases the perceived sharpness of the image, but at the expense of large area fill. Since a large percentage of monochrome electrophotographic print engines are used primarily to copy text, this has conventionally been viewed as a very acceptable trade off.

The present inventors have developed what they believe to be an accurate model for why the use of conventional resistive developer materials causes significant halo in color print engines and, applying the teachings of this model, have achieved printed output from a color electrophotographic print engine embodying the present invention with much less halo than is encountered in the prior art without sacrificing fill density. In particular, it is well known to those skilled in the art that one encounters rotations of the electric field gradient in the field between a toner brush at a development station and a charged photoreceptor carrying a latent image. The rotation of the field gradient occurs around boundaries between highly charged and discharged portions of the photoreceptor corresponding to dark areas of the image and light areas of the image, respectively. The rotation of the field gradient causes an excess of toner to accumulate at the boundary and thus explains the above described phenomenon of increased density at boundary areas in monochromatic electrophotographic machines.

The high resistivity of such toner materials also explains the absence of good fill in large dark areas. The highly resistive developer materials, like any material of very high bulk resistivity, cannot distribute local maxima of charges due to their lack of conductivity. Thus, there tends to be small localized areas of varying triboelectric charge density on the developer brush. Therefore, toner is transferred to the photoreceptor with a non-uniform density during development of large areas. It should be noted that this phenomenon rarely causes any visible degradation in a text image since slight variations between the densities of adjacent letters are imperceivable, but varying densities of a continuous dark area are less attractive and quite noticeable.

The conventional wisdom of prior art monochromatic electrophotography is that decreasing the resistivity of the toner materials improves the fill problem but at the expense of sharpness on the image boundary.

The present inventors believe that significant halo encountered in conventional full color electrophotographic print engines results in large part from the use of highly resistive developer materials. In particular, it is believed that the resistive developer materials cannot dissipate the local maxima of charge at developed image boundaries which results from the gradient rotation at the boundary, which in turn results from accumulations of excess toner materials at a boundary. Since the toner materials are so resistive, the excess of toner materials near the boundary tends to create an excess of charge on the first and second layers transferred. Transfers of subsequent layers encounter a higher electric field contribution from these local maxima near the boundary field which, the inventors believe, causes dissipation of the toner near the boundary during subsequent transfer steps due to field gradient rotation.

Lastly, it is known to those skilled in the art that it is more difficult to produce good black coloration by using the composite pigment resulting from three individual pigments than by using black toner materials of the type used in monochromatic print engines.

To summarize much of what is discussed above, the art of full color electrophotography is significantly more complex than that of conventional monochromatic electrophotography. The complexity arises primarily from the problems encountered in transferring multiple toner images, and from the greater sensitivity of the human observer to image distortions in the final printed output for a color image than to physically similar distortions in a monochromatic image. From a practical point of salability and utility of color electrophotographic print engines, users have higher expectations from color electrophotography than monochrome electrophotography. This is due to both human sensitivity to color images and the higher price of color machines.

Most problems (other than registration) arising in image quality in full color electrophotography are caused by classes of phenomenon related to the effects of earlier transferred toner images on the transfer of subsequently transferred images. These include non-uniformity of forward transfer due to field non-uniformities and back transfer phenomena. The art of designing color electrophotographic print engines is, in large part, the problem of attempting to understand the physical mechanisms involved and to select appropriate trade offs among parameters which impact the ultimate image quality.

SUMMARY OF THE PRESENT INVENTION

In its broadest conception, the present invention, and the various significant aspects thereof, may be considered as a full color electrophotographic print engine in which various operating parameters have been adjusted so that the overall result is believed to be close to optimal.

An important element of the present invention, which impacts many other aspects thereof, is the use of an image receiving web having a characteristic surface resistivity which falls within a predetermined range of surface resistivities, preferably $10^7$ to $10^{10}$ ohms. In passing, some of the nomenclature adopted in the present specification should be explained. The preferred embodiment of the present invention is a double transfer full color electrophotographic print engine. The phrase "double transfer" refers to the fact that the composite color developed image is built up, one separated image at a time, on an intermediate image receiving surface and the entire developed composite image is then transferred to a final print receptor, normally a sheet of paper. Several of the improvements of the present invention have great utility in the environment of a single transfer print engine, either monochromatic or color. As is known to those skilled in the art, a single transfer color electrophotographic print engine is one in which each developed separated image is transferred directly onto the final image receptor, such as that disclosed in the Langdon U.S. Pat. No. 3,729,311, id.

Therefore, as used herein, the term "image receptor" refers to the material upon which the final printed image appears, i.e., a sheet of paper, a piece of plastic transparent material, etc. The term "image receiving web" refers to any web which receives one or more developed images, whether intermediate or final, and irrespective of whether same is mounted on or about a belt, drum, or other device for carrying the web. Therefore, image receiving web is the generic term and includes image receptors, as those terms are used herein.

According to another aspect of the present invention, excellent toner transfer is accomplished by using lower applied voltages at transfer stations than have been successfully used in prior art full color machines. According to one form of the present invention, the length of the transfer station, considered along a line parallel to the direction of travel of the image carrying devices, is increased over that which was used in the prior art. This has the effect of increasing the effective capacitance of the transfer station and also developed image dwell time within the transfer station, which results in improved forward transfer.

The combination of lower applied voltages and proper selection of the surface resistivity of the image receiving web or the web in contact with the final print receptor, together with the mechanisms which allow the use of low applied voltages, provide a system in which direct application of the electric field through web contacts can be used, thus eliminating coronas and the consequent performance variations due to environmental factors, particularly humidity.

Thus, the present invention's provision of a practical low applied voltage transfer station, together with proper selection of the web surface resistivity, has been found to produce a full color print engine which overcomes problems of electric discharge encountered in prior art print engines.

An important mechanism of the present invention is its use of a selectively engaged roller at a transfer station, which roller constitutes one electrode of the apparatus for applying the electrostatic field to induce transfer. The use of a second electrode displaced along the direction of travel of an image carrying web to define the other pole of the apparatus applying the electric field is a substantial improvement, and is made possible by proper selection of web surface and bulk resistivities.

According to another aspect of the present invention, the selectively engaged roller at a transfer station has the electric field thereto applied through a conductive brush. A second conductive brush providing a safety ground to the roller contacts same when it is in its disengaged position away from the transfer station. In the preferred embodiment, this is highly desirable since the user can contact the selectively engageable roller when the machine cover is open. The grounding brush therefore provides both a safety feature as well as a discharge path which aids in roller cleaning.

According to another aspect of the present invention, a cleaning station for this selectively engageable roller is positioned so that the roller contacts same when it is in its disengaged position. In the preferred embodiment, rotary drive is picked off from an available rotating member elsewhere in the system (synchronization to machine speed being unimportant) and the roller is rotated past a cleaning blade at its cleaning station. According to a preferred form of this aspect of the present invention, the cleaning blade may be an integral edge of a toner receiving tray at the cleaning station.

Therefore, one form of the present invention comprises a belt for carrying a developed toner image thereon having a characteristic surface resistivity in the range of $10^7$ to $10^{10}$ ohms. A first roller is disposed on one side of the belt to the transfer station and the second, selectively engageable roller, is disposed on the other side of the belt at the transfer station. One polarity of the applied electric field is applied by placing a particular potential on the second roller and the other pole of the field is applied by maintaining a plate electrode disposed on the other side of the web from the second roller at a particular potential. Due to proper selection of belt characteristics, the second electrode can be, and is, displaced from the transfer station along the direction of travel of the images through the transfer station.

Additionally, the bulk resistivity of the transfer belt is particularly important in assuring the belt has a proper discharge characteristic. In the preferred embodiment of the present invention, several mechanical members also serve as grounded electrodes providing a discharge path for the belt downstream from the transfer station at which a high electrostatic field is applied to the belt, the developed toner image, and one or more image receiving webs. This induces substantial surface charges on the belt in the same manner as a charged capacitor. It is important that the belts have a proper discharge characteristic so that the induced charge picked up from the transfer station can be taken off during each revolution of the belt prior to the time that a subsequent image is to be transferred thereto. Discharge of the belt is important both for cleaning purposes and to establish a relatively uniform surface charge condition to be presented to the next image to be transferred thereon.

On the other hand, it is important that the belt not completely discharge so as not to cause previously transferred toner images to fall off the belt prior to transfer of the composite image to the ultimate print receptor. To this end, the bulk resistivity characteristic of the belt determines the extent to which charge from the surface of the belt opposite the grounding electrodes can flow through the belt and find an adequate discharge path to ground. In the preferred embodiment, the bulk resistivity characteristic is selected so that the belt will substantially discharge 90 percent of its initial value within the time it takes the belt to make one complete cycle of its path.

According to a preferred form of the present invention, the stepped applied field used during sequential transfer of developed separated images is achieved by applying a potential difference of substantially 250 volts for transfer of the first image, substantially 325 volts for the second image, and substantially 400 volts for the third image.

According to another aspect of the present invention, the developed composite image is transferred to the image receptor using a relatively low applied voltage, preferably in the range of 600 to 2,000 volts.

According to another aspect of the present invention, the triboelectric charges for the toner materials used for developing the separated images in a color electrophotographic print engine are sequentially stepped so that, for the second and third images developed, the toners have a successively increasing triboelectric charge characteristic as compared to the previously transferred toner. According to yet another aspect of the present invention, toner characteristics are chosen such that the triboelectric charge is preferably in the range of 10 to 14 microcoulombs per gram, which is considered too low for effective transfer by the conventional wisdom of the prior art. Typically, toner materials with triboelectric charges in the range of 15 to 20 microcoulombs per gram are used in other color electrophotographic print engines and Xerox Corporation normally uses toner materials in its monochromatic print engines which have a 20 to 30 microcoulombs per gram triboelectric charge characteristic.

According to yet another aspect of the present invention concerning toner materials, materials which are more conductive than those used in practical print engines in the prior art are employed. In the preferred embodiment of the present invention, a toner material is used which has a characteristic bulk resistivity lower than that considered in the practical range for prior art electrophotographic print engines. Preferably, the bulk resistivity of the toner materials is in the range of $1\times10^9$ to $5\times10^9$ ohm centimeters whereas, conventionally, toner materials having bulk resistivities greater than or equal to $10^{10}$ ohm centimeters are employed.

In the present invention, the combination of somewhat more conductive toner materials and the lower characteristic triboelectric charge is believed to provide the significant improvement in halo characteristics at image boundaries which the inventors of the present invention have found to result from use of the present invention. The decrease in resistivity allows dissipation of local maxima of charge, as described above, and thus achieves one of the major design goals of the present invention, i.e. uniform field characteristics for forward transfer as second and third developed images are transferred from the photoreceptor. Additionally, the use of toner materials having triboelectric charge characteristics lower than that considered normally acceptable leads to the following result. It is known that for a constant mass per unit area of toner materials, lowering the triboelectric charge of the materials lowers the resultant opposing voltage contribution to the electrostatic field from previously transferred images.

The inventors of the present invention believe that the following phenomenon accounts for this significantly improved result. As the contribution to the local electrostatic field from the previously transferred toner images diminishes (through the use of toner materials having lower characteristic triboelectric charges) the less the contribution to the field from the previously transferred images. This leads to a reduction in the rotation of the field gradient at boundary areas and thus leads to less halo in the ultimate printed image.

Additionally, so long as forward transfer can be reliably accomplished, the use of lower triboelectric charges on the toner materials decreases the electrostatic repulsion that previously transferred images have for a subsequent image about to be transferred.

According to yet another aspect of the present invention, a discharge lamp is applied to the developed image just before it reaches the transfer station. The discharge lamp causes sufficient light to pass through the color pigmented toner materials to at least partially discharge the photoreceptor underneath the materials. This predischarging has two significant impacts on the color transfer process. First, it loosens the electrostatic grip the charged areas of the photoreceptor retain on the toner particles in the developed image. This aids in the forward transfer using a lower applied electrostatic field. Secondly, predischarging the charged areas of the photoreceptor where a developed image is present causes the photoreceptor to become more uniformly surface charge characteristic than one normally encounters when trying to pull toner directly off a photoreceptor having charged and discharged portions. This aids in uniformity of forward transfer and reduction of back transfer.

According to a preferred embodiment of this aspect of the present invention, the luminous flux density output from the predischarging lamp is stepped according to the luminous absorption characteristic of each toner material. Thus, for a constant specified toner density covering a charged portion of the photoreceptor belt, the predischarging lamp will apply approximately constant luminous flux density to the charged area of the belt, thus reducing, uniformly for each pigment, the electrostatic pull that the photoreceptor has for the toner.

According to still another preferred form of the present invention particularly useful in a color print engine having a digitized input, i.e., a laser printer or a digital scanning copier, four toner pigments are used in full color copying. In this embodiment, in addition to the three normal pigments, monochrome black is used either to develop black portions of the image by itself, or to enhance black or very dense dark portions of the image in which the process pigments are also used.

According to this aspect of the present invention, each pixel is analyzed for black content and density. Areas having sufficient black content have a monochrome black developed image created first. As described in more detail hereinbelow, this leads to a circumstance where the black toner materials appear on the top of the final printed image thus causing the maximum density in black or near black portions of the image where high pigment saturation is desired.

The principle object of the present invention is to provide a full color electrophotographic print engine which approximates ideal transfer conditions as closely as reasonably possible. In particular, design goals are uniformity of the electrostatic field characteristics at the transfer station by presenting as uniform a surface charge on each side of the transfer station as the variations in toner density dictated by the image characteristics will allow. Additionally, maximizing the efficiency of the forward transfer process by increasing the efficiency of the transfer station under lower applied voltage conditions and proper selection of toner characteristics is a fundamental object of the present invention. It is an object of the present invention to provide an electrophotographic print engine which minimizes the use of coronas, particularly at transfer stations. Additionally, the present invention is designed to minimize problems encountered with the creation of discharge paths in conventional print engines using high applied voltages at transfer stations.

That the present invention overcomes the drawbacks of the prior art cited above, and accomplishes the objects and purposes stated hereinabove, will be apparent from the description of the preferred embodiment below.

DETAILED DESCRIPTION OF THE DRAWINGS

Figure 1:
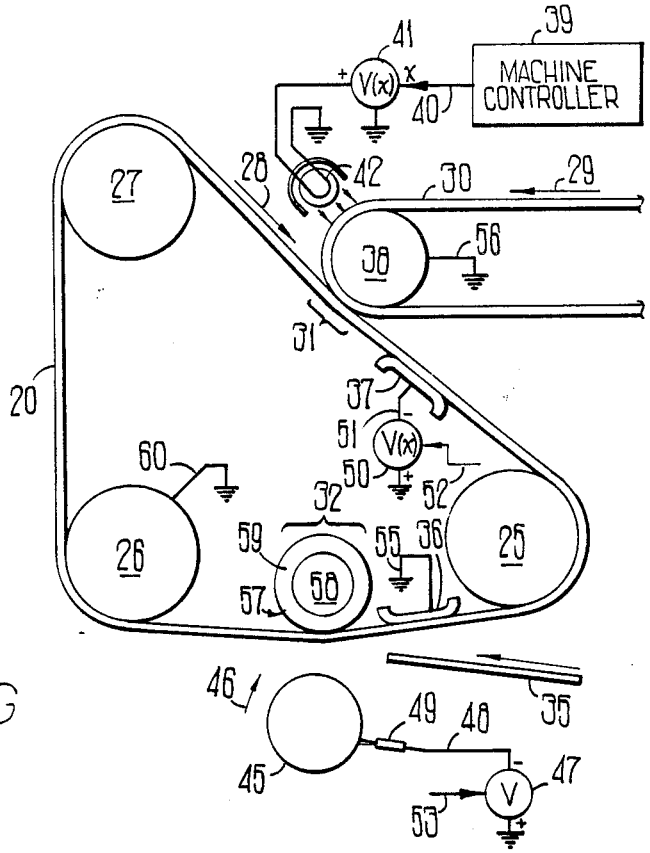
FIG. 1 is a side elevational view of the two transfer stations of the preferred embodiment of the present invention.

Turning next to the drawing figures in which like numerals represent like parts the preferred embodiment, and several alternate embodiments, of the present invention will now be described.

The preferred embodiment of the present invention is a two belt double transfer full color electrophotographic print engine generally of the type disclosed in U.S. Pat. No. 4,697,920 to Palm, et al., cited above. As noted in the disclosure of the Palm patent, significant belt control problems were initially encountered and overcome by the machine controller described therein. A substantially similar machine controller is used in the preferred embodiment of the present invention and, in view of the description thereof contained in the Palm '920 patent, need not be described in detail herein. U.S. Pat. No. 4,697,920 is hereby incorporated by reference exactly as if set forth in full herein.

FIG. 1 shows an elevational diagram of the transfer stations of the preferred embodiment of the present invention. It should be noted that the structure shown therein is similar to the double transfer system shown in FIG. 6 of Palm U.S. Pat. No. 4,697,920 in that transfer belt 20 is wrapped around three rollers 25, 26 and 27 and driven in the direction of arrow 28. Arrow 29 shows the direction of movement of the photoreceptor. Images developed on photoreceptor 30 are transferred to transfer belt 20 at a separated image transfer station 31. A composite developed toner image is transferred to an image receptor, embodied by paper 35, at a composite image transfer station 32. Plate electrodes 36 and 37 contact the inside of transfer belt 20. Photoreceptor belt 30 rotates about roller 38 at transfer station 31.

A machine controller 39 represents the overall synchronized digital controller of the type disclosed in U.S. Pat. No. 4,697,920, incorporated by reference hereinabove. An output which appears on line 40 is connected to a variable voltage source 41, the output of which drives predischarging lamp 42. A movable transfer roller 45 is disposed at composite image transfer station 32 and can be selectively moved into contact with belt 20 in the direction of arrow 46 under the control of machine controller 39.

A voltage source 47 is connected by conductor 48 to a brush 49 which in turn contacts the surface of roller 45. This is used to maintain a negative potential on roller 45 during transfer of the composite image. A second voltage source 50 is connected by conductor 51 to plate 37. Voltage source 50 is a controlled voltage source, the output of which is controlled by a voltage signal on line 52 from machine controller 39 (see FIG. 3).

In the preferred embodiment, plate 36 is maintained at a ground potential through conductor 55 and roller 38 is maintained at ground potential through conductor 56 which may be connected to the roller through a brush, metallic contact, or any other suitable arrangement. A roller 57 at composite image transfer station 32 includes a metallic core 58 and a rubber outer coating 59. Roller 26 is maintained at ground potential through a grounded conductor 60.

Figure 2:
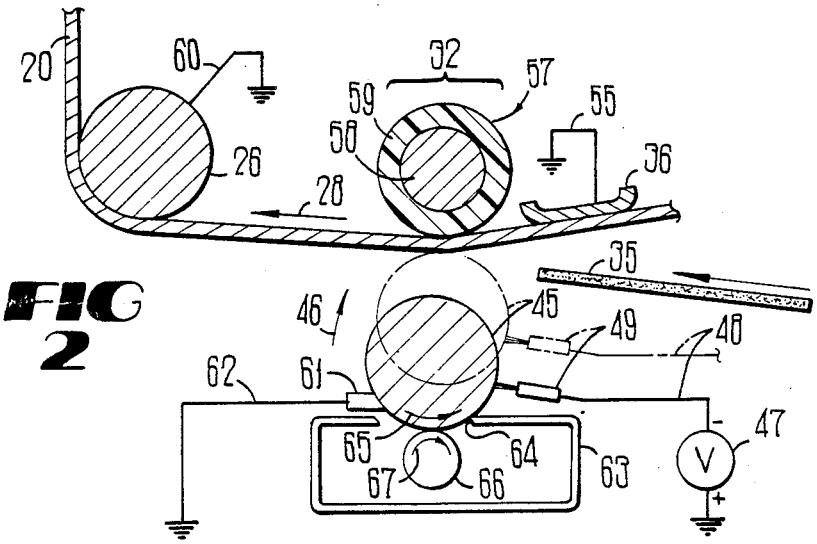
FIG. 2 is a side elevation section view of the composite image transfer station of the preferred embodiment.

Details of composite image transfer station 32 are shown in FIG. 2. As noted hereinabove, roller 45 is selectively movable between the position shown in asserted form in FIG. 2 and its position shown in phantom thereon. As represented in FIG. 2, brush 49 retains its contact with roller 45 in either position. A second brush 61 is connected to ground through conductor 62 and contacts roller 45 only when it is in lower position shown in FIG. 2.

When roller 45 is in its lower position, it rotates in the direction of arrow 65 under the influence of a driven roller, shown in phantom at 66. Driven roller 66 rotates in the direction of arrow 67. In the preferred embodiment, roller 67 is belt driven off any convenient linkage to another rotating member since it is not critical that rotation of roller 45, when in the down position, be synchronized to the machine speed. Therefore, driving roller 66 may be of any convenient diameter and, within practical limits, may rotate at any speed sufficient to make sure roller 45 accomplishes several rotations each time it is in the down position.

When the roller is in the down position, it is brought into contact with a cleaning station consisting of tray 63 and cleaning blade 64. As noted above, roller 45 is rotated under the influence of rotating member 67 when roller 45 is in the down position. This causes cleaning blade 64 to contact the periphery of roller 45 and to scrape off any residual toner particles present thereon. In the preferred embodiment, blade 66 is integrally formed with one edge of the opening of cleaning station tray 63. However, other more conventional forms of cleaning blades can be used in place of blade 66 in embodiments of the present invention.

The fact that brush 61 contacts roller 45, and gives same a secure electrical path to ground through conductor 62 when in the down position, assures that electrostatic forces tending to hold any toner particles on roller 45 are discharged.

Since roller 45 contacts the bottom (that is, the nonimage side) of paper 35 during image transfer, it ideally would not ever have any toner particles thereon. However, there is particle spill, particles within the atmosphere of the machine, and other ways for contaminant toner particles to arrive at the surface of roller 45. Since it is held at a relatively high negative potential during image transfer, it tends to attract any available positively charged toner particles. Furthermore, since it does contact the nonimage bearing side of the paper, it is important that the roller be very clean so as not to deposit extraneous pigments on the back side of the paper which will be fused thereto during passage of the paper through the fuser (not shown).

Figure 3:
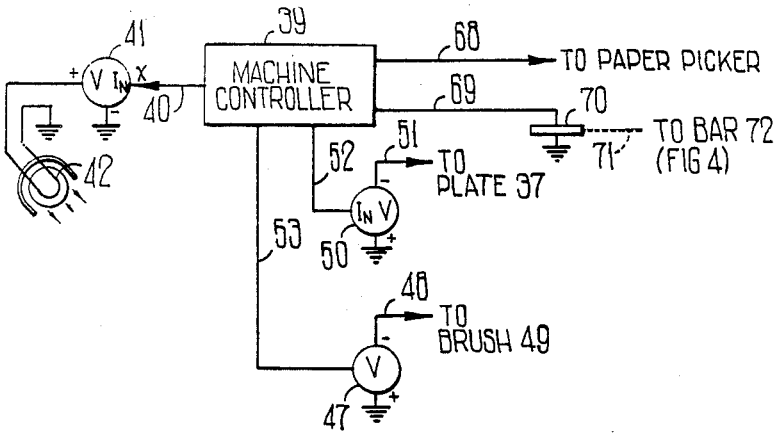
FIG. 3 is a block diagram of the voltage stepping apparatus using the preferred embodiment of the present invention.

Before continuing with the description of the physical structure of the transfer stations, a simple schematic of the control of the variable voltage sources used in the preferred embodiment is shown in FIG. 3. Machine controller 39 has been described hereinabove as of the type disclosed in U.S. Pat. No. 4,697,920. Lines 40 and 52 go to variable voltages sources 41 and 50, respectively. Another output line 68 goes to activate a conventional paper picker (not shown) when it is time to feed a sheet of image receptor into composite image transfer station 32 (FIG. 2). An additional control line 69 from machine controller 39 operates solenoid 70. Solenoid 70 is indicated by dashed line 71 as having a mechanical connection to bar 72 shown in FIG. 4.

Figure 4:
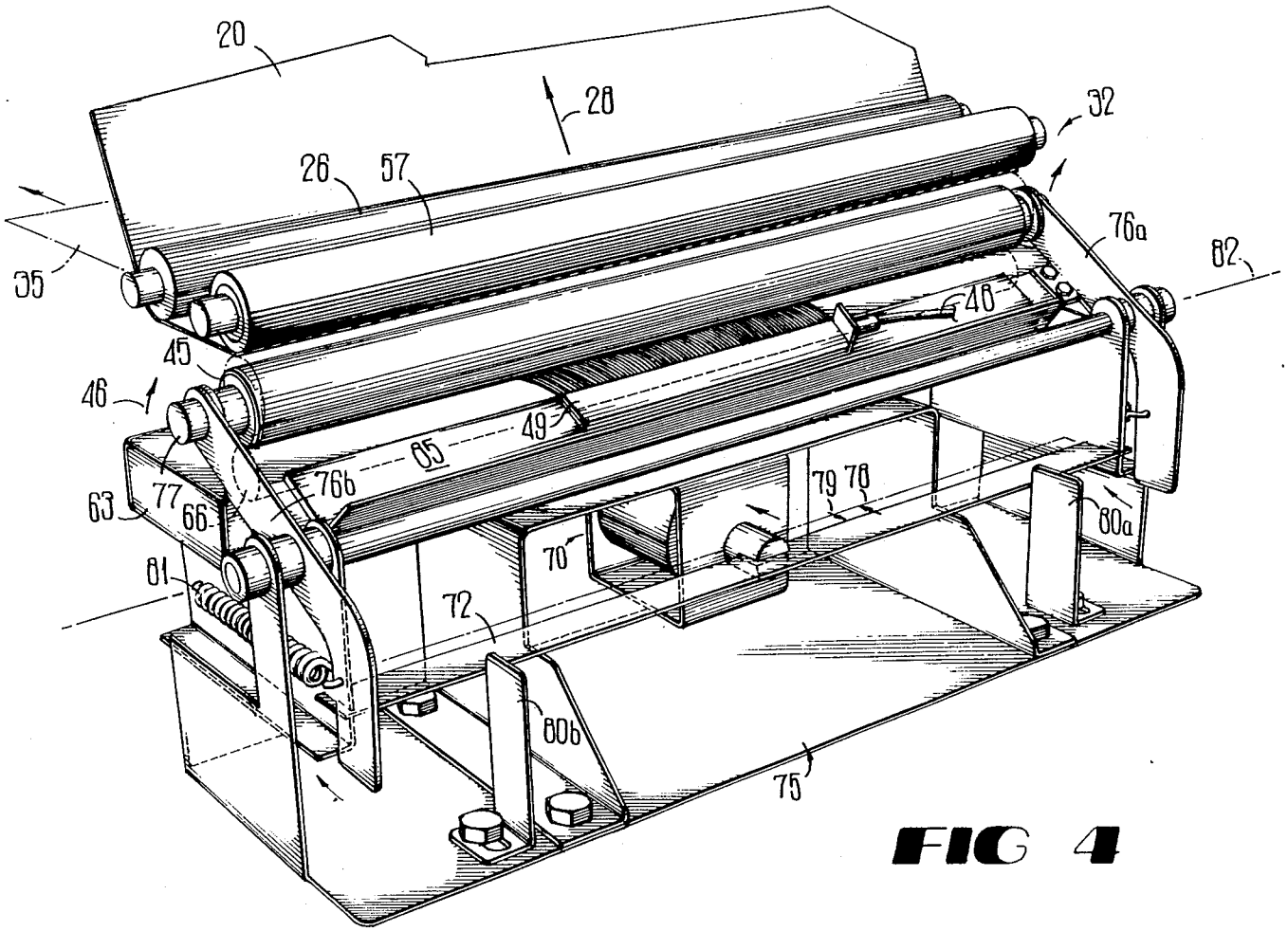
FIG. 4 is a pictorial view of the lower portion of the composite image transfer station of the preferred embodiment.

Additionally, line 53 controls voltage source 47, the output of which appears on conductor 48, which in turn is provided to brush 49, which is in contact with roller 45. The signal on line 53 simply turns voltage source 47 on and off when in its up and down positions, respectively. When in the down position, the voltage source needs to be off so that it is not shorted by roller 45's contact with grounded brush 61. In the event voltage source 47 ever fails to turn off, the grounding of roller 45 through brush 61 in its down position will short the roller to ground causing an appropriate over-current device (not shown) in the physical embodiment of voltage source 47 to trip, thus protecting the user from coming in contact with a high voltage potential on roller 45. This is an important safety factor because, as shown in FIG. 4, when the preferred embodiment of the present invention is opened, the user can easily establish hand contact with roller 45.

Voltage source 41 controls the output of predischarging lamp 42 to illuminate photoreceptor belt 30 just prior to a developed image reaching separated image transfer station 31, as shown in FIG. 1. In the preferred embodiment, the voltage output from voltage source 41 is adjusted in a step wise fashion as each developed separated image approaches transfer station 31. The control signal on line 40 adjusts the output of control voltage source 41 to determine the luminous flux density output from predischarge lamp 42 in accordance with the absorption characteristic of the particular toner used to develop the separated image approaching transfer station 31.

In embodiments of the present invention in which four toner materials are used, including monochrome black toner, the predischarge lamp 42 is not illuminated during passage of the developed black image. This is because black toner materials have a high absorption characteristic. It should be noted that the black toner materials being developed first in such embodiments provides two operating advantages. First, since the predischarge lamp 42 is ineffective with black toner materials, it is desirable to have maximum uniformity of the electric field at transfer station 31 when the black toner materials are transferred because the advantage of predischarging the photoreceptor is not obtained. Therefore, the black toner material is transferred first and does not have to contend with any previously transferred toners on transfer belt 20.

An additional advantage is obtained from developing the black toner first since it will then be the first toner image laid down on transfer belt 20. In a double transfer system, toner materials appear in the composite image transferred to the image receptor in the opposite order from that in which they were developed. Thus, the first toner material (black in this instance) developed and transferred to transfer belt 20 is the farthest away from paper 35 when the composite image is transferred thereto. This puts the black toner materials on top where they can do the maximum good in providing additional fill for dark image areas. It should be noted that the use of four color development is contemplated in applications of the print engine in the present invention having digitized signal sources such as laser printers and copying machines employing digitized scanners. In these applications, the black toner can be used either as the only toner which develops an image at each pixel where the image processing apparatus detects a black output, or can be used to selectively fill and enhance highly saturated black or near black areas of the image.

As may be seen from FIG. 3, in the preferred embodiment the actual parameter controlled is the voltage output from controlled voltage source 41 driving lamp 42. The voltage of control signal 40 is empirically adjusted until a uniform discharge characteristic is obtained for the photoreceptor belt having a uniform density per unit area of toner materials of the various pigments deposited thereon. From this, it can be determined that the luminous flux density output from lamp 42 is adjusted in accordance with the absorption characteristic of each toner.

Additionally, it should be understood that the voltage controlling voltage source 41 can be empirically adjusted so that the luminous flux density through each color pigmented toner material during operation of predischarge lamp 42 provides the most uniform transfer of toner materials when creating process black in a fashion that compensates for any variations due to the stepped applied electric fields during image transfer at transfer station 31, and the variable triboelectric charge characteristics of the differently pigmented toners, described in detail hereinbelow. This is because it may not turn out that a constant discharge characteristic on the underlying photoreceptor is, in fact, the most desirable parameter in a full color machine in which the applied electrostatic field differs for each pigment and the triboelectric charge characteristics of the toners differ for each pigment.

A signal output on line 52 from controller 39 controls the output from voltage source 50 which is connected by line 51 to plate 37 (FIG. 1). The output on line 51 is a negative voltage and is stepped according to the particular one of the developed separated images being transferred onto transfer belt 20. The magnitude of the output on line 51 increases with the transfer of each sequential developed image in building up a composite developed image on transfer belt 20. As may be seen from inspection of FIG. 1, a negative voltage on plate 37 creates an electric field between the electrode represented by grounded roller 38 and plate 37, which field passes through belt 20 and the toner materials at transfer station 31.

Turning next to FIG. 4, a pictorial view of the portion of the preferred embodiment shown in FIGS. 1 and 2 is seen. FIG. 4 should assist the reader in understanding, in a three dimensional perspective, the physical embodiment of the apparatus represented diagrammatically in FIGS. 1 and 2. FIG. 4 is a perspective view of a portion of a copying machine which is the environment of the preferred embodiment of the present invention. A frame 75 carries the apparatus of composite image transfer station 32 and is rigidly fixed to the lower portion of a body of the machine.

Movable roller 45 is mounted on a pivoting carriage constructed of rocker arms **76*a* and 76*b*, bar 72, and a mandrel shown at 77. Roller 45 rotates about mandrel 77. Solenoid 70 contacts bar 72 and moves same back and forth in the directions of arrows 78 and 79 shown in FIG. 4**.

Electrical brush 49 is connected to conductor 48 and remains in constant contact with roller 45 as shown in FIGS. 1 and 2. The brush and conductor are carried on another bar 85 which is rigidly attached to arms **76*a* and 76*b*. This keeps the brush in constant contact with roller 45**.

An engagement spring 81 is under tension and urges bar 72 in the direction of arrow 78 shown in FIG. 4. Movement of bar 72 in this direction causes the moveable carriage carrying roller 45 to rotate about axis 82, thus raising the roller toward its engagement position in which it contacts belt 20 and urges same against roller 57.

The operation of this mechanism is as follows. When solenoid 70 is deactivated, an internal spring (not shown) pushes bar 72 in the direction of arrow 79 with sufficient force to overcome the tension exerted by spring 81. Travel of bar 72 is limited by stops **80*a* and 80*b*. Roller 45 is disengaged from transfer belt 20 under these conditions. When machine controller 39 (FIG. 3) detects that a complete composite developed image has been created on transfer belt 20, and that same is approaching transfer station 32, a signal is provided on line 68 (FIG. 3) to a conventional paper picker (not shown) and a sheet of paper 35 is moved into transfer station 32 between transfer belt 20 and roller 45**.

Under the timed control of machine controller 39, solenoid 70 is activated when the leading edge of the paper is just past the center line of the transfer station so that the top portion of paper will be pressed between roller 45 and belt 20. When this condition occurs, solenoid 70 is activated causing it to pull in and overcome the force of its internal spring. This removes the influence of solenoid 70 from the pivoting carriage and bar 72 moves in the direction of arrow 78 in response to the tension applied by spring 81. It will therefore be appreciated that under these conditions, roller 45 moves upward in the direction of arrow 46 contacting the paper which is urged against belt 20 and roller 57. It should be noted that this arrangement allows spring 81 to determine the force with which roller 45 is urged up against belt 20.

Controller 39 outputs a signal on line 53 to activate voltage source 47 (FIG. 3). Since brush 49 is mounted on bar 85, which in turn is rigidly attached to the pivoting carriage, brush 49 remains in contact with the roller and establishes the electrical potential thereon.

When transfer of the developed composite image to paper 35 is completed, solenoid 70 is once again turned off and its internal spring urges bar 72 in the direction of arrow 79, overcoming the tension applied by spring 81 and roller 45 returns to its disengaged position. Voltage source 47 is then turned off.

When roller 45 returns to its disengaged position, rotating member 66 (not visible in FIG. 4) engages what is the right hand end of mandrel 77 as the mandrel is seen in FIG. 4. The cleaning station consisting of tray 63 and cleaning blade 64 is not shown in FIG. 4.

Figure 5A:
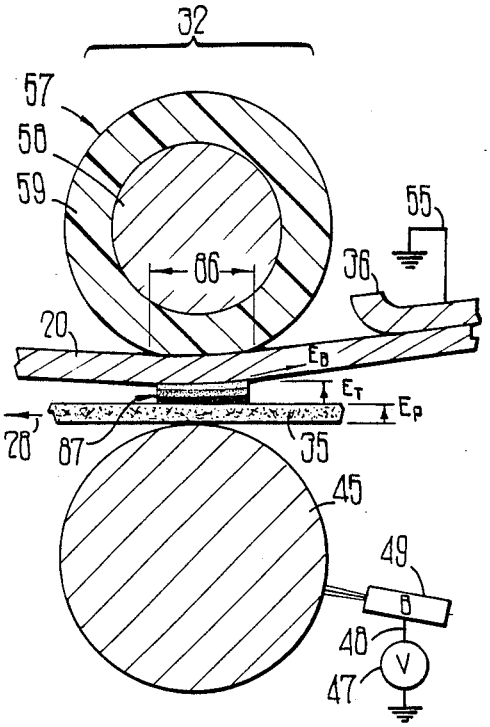
FIG. 5A is a detail of the composite image transfer station of FIG. 2, diagrammatically representing image transfer at the station.

Turning next to FIG. 5A, a detail of transfer station 32 is shown with a diagrammatic representation of toner representing a developed composite image.

First, an important aspect of composite transfer station 32 is its length, i.e. the distance represented by dimension line 86 in FIG. 5A.

The following should be understood with respect to all drawing figures representing toner transfer at transfer stations 31 and 32 in this specification. These drawings are not intended to be to scale and some of the neat boundaries between toner layers and the like are, for obvious reasons, only approximations to what physically occurs as toner is transferred between image receiving webs in the preferred embodiment. The toners are under considerable physical force and, naturally, there is some compression and mixing. However, the diagrams represent models adopted by the present inventors in analyzing transfer problems encountered in full color electrophotographic print engines. The strikingly improved results obtained by the present invention from applying the results of these models to solve transfer problems which have plagued the prior art, demonstrates that the models are valid for purposes of analyzing performance of such a print engine.

The length of transfer station 32, shown by dimension line 86, is made possible primarily by the use of rubber covering 59 on roller 57. As spring 81 (FIG. 4) urges roller 45 upward, rubber coating 59 is deformed, as shown in FIG. 5A, and a broad area for the nip is created in the transfer zone. This has several beneficial effects described hereinbelow.

In FIG. 5A, the developed composite image is represented by toner 87, as shown within transfer station 32. The applied electric field is generated between roller 45 which is held to a constant potential between −600 and −2,000 volts, preferably approximately −1,000 volts, and plate 36 which is grounded by conductor 55. The applied field may be conveniently analyzed by breaking it down into component portions shown as $E_p$, $E_t$, and $E_b$, which represent the electric fields across the paper, the toner in the composite image, and belt 20, respectively. As is known to those skilled in the art, at a transfer station for transferring toner to a final image receptor, the substantial majority of the voltage of the applied field is dropped in field component $E_p$, the field across the paper. This is particularly true for papers of the type commonly used in the United States and Europe which tend to be relatively thick bond, as compared to thinner papers commonly used in the Orient.

The beneficial results of the substantial length of transfer station 32 of the preferred embodiment are essentially as follows. First, the dwell time of the composite image and the paper in the transfer station is increased. The dwell time is the length of the dimension represented by line 86 divided by the speed at which the paper moves through the transfer station in the direction of arrow 28. It has been found empirically that increased dwell time increases the overall efficiency of forward transfer.

A second beneficial result of the pressure applied by roller 45 is its tendency to compress the toners of composite image 87. In the preferred embodiment, spring 81 (FIG. 4) applies approximately one to three kilograms of force over the entire nip area represented by dimension line 86. It should be noted that an equivalent circuit model between belt 20 and paper 35 includes a substantial capacitance of the toners of composite image 87. Since both the belts and the paper are relatively incompressible, as compared to toner image 87, the physical characteristics of the belt and the paper determining field components $E_b$ and $E_p$ remain substantially constant, as compared to those parameters determining field component $E_t$ for the toner. As the toner is squeezed in transfer station 32, it has the same effect as bringing the plates of a capacitor closer together wherein the plates hold a substantially constant charge. Under this analysis, belt 20 and paper 35 constitute the plates of the capacitor. As is well known to those skilled in the art, bringing the plates of capacitor closer together, wherein the charge on the plates remain substantially constant, lowers the voltage across the capacitor. Thus, as the toner image 87 is squeezed in the transfer station, the field component $E_t$ across the toner decreases. This tends to reduce the repulsive forces on the top layers of toner and aids in complete transfer of the entire composite image.

At this point, it is appropriate to explore the benefits derived from selection of proper surface resistivity for belt 20. As is known to those skilled in the art, materials considered good insulating surfaces are usually classified as those having resistivities on the order of $10^{14}$ ohm or more. The inventors of the present invention have found that maintaining the surface resistivity of transfer belt 20 in the range of $10^7$ to $10^{10}$ ohm has substantially beneficial results in a transfer station constructed according to the present invention. The inventors have used carbon filled polyvinyl fluoride and carbon filled polyvinylidine as belt materials. However, there are numerous other polymers which can be doped with carbon to create belts of appropriate physical characteristics which also have surface and bulk resistivities within the desired range set forth herein.

The inventors of the present invention believe that the following model explains the benefits derived from using a belt with a surface resistivity in the range specified herein. First, consider the situation in which electrical breakdown occurs between roller 45 and belt 20. When this occurs, electron current (in the opposite direction of mathematical current) will tend to flow from roller 45 into belt 20 toward grounded plate 36. Providing belt 20 with a surface resistivity in the above described range assures a high enough resistivity such that substantial current limiting occurs in the event of a breakdown and serious damage to the belt does not occur.

Secondly, and the inventors believe more importantly, is the fact that the surface resistivity of belt 20 is low enough to allow dissipation of local maxima of charge which thus prevents breakdown from occurring in the first place. Local maxima of charge can occur from areas of high toner concentration, and the non-uniform distribution of triboelectric charge on particular portions of the toner materials forming the image. When local charge maxima accumulate, extremely high electric field intensities around small areas can be created and thus tend to cause breakdown. Proper selection of the surface resistivity of the belt, aided in part by the selection of slightly conductive developer materials (described hereinabove) allow the local charge maxima to dissipate and spread out so that the field strength tends to remain uniform over the nip area 86 of transfer station 32. This prevents breakdown from occurring in the first place.

Additionally, the relatively high surface conductivity of belt 20, as compared to those used in the prior art, allows plate 36 to be displaced along the direction of travel of belt 20 from the transfer station and still be properly used as one of the electrodes in creating the applied field for causing toner transfer. This allows the very simple expedient of a metallic plate to be used, thus eliminating the need for additional brushes or commutator rings on a roller such as roller 57. It should also be noted that if roller 57 were held to a constant potential to create the applied electrostatic field across the transfer zone, it would be extremely difficult, if not impossible, to use a roller having rubber coating 59, which coating allows the wide area of the nip at the transfer station to be created in the first place.

Also, as shown in FIG. 5A, the electrostatic field component $E_b$ within belt 20 lies in a direction from transfer station 32 toward grounded plate 36. Therefore, there is a substantial physical distance between transfer station 32 and plate 36 which constitutes one electrode used in generating the applied field. The substantial distance acts as a spatial current limiter over this length of belt materials, thus overcoming the problems one would expect to encounter if a low resistivity belt were used in a transfer station at which the field applying electrodes were directly opposite each other on opposite sides of the belt. By providing a current limiter, the bulk resistivity aids in preventing electrical breakdown in the area of transfer station 32.

Figure 5B:
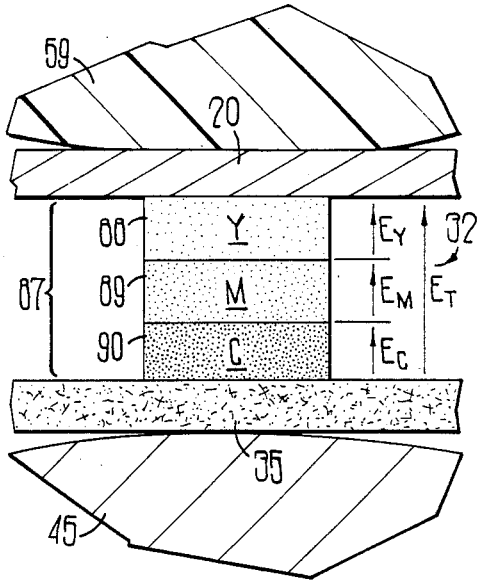
FIG. 5B is a detail diagrammatic representation of the composite image transfer shown in FIG. 5A.

Turning next to FIG. 5B, an advantage of the order in which the toner pigments are developed in the preferred embodiment will now be described. FIG. 5B is a detailed diagrammatic representation of a highly saturated composite image for developing an area of the final image on final image receptor 35 which is intended to be process black. Therefore, equal densities of yellow toner 88, magenta toner 89, and cyan toner 90 have been deposited during the transfer of the toner materials comprising composite image 87. Again, the spacing represented in FIG. 5 is not intended to be to scale, but to only illustrate the principles involved in the mechanisms which affect toner transfer at composite image transfer station 32.

In the preferred embodiment when three processed colors are used, they are developed on photoreceptor 30 in the order yellow, magenta, cyan. In commercial full color electrophotographic print engines manufactured by Xerox Corporation, and most literature known to the present inventors, it is recommended that this be the development order in single transfer full color electrophotographic print engines. The disclosure of U.S. Pat. No. 3,729,311 to Langdon indicates that colors can be developed in any suitable order which, in abstract principle, is true. Langdon disclosed a preferred development order of yellow, cyan, magenta.

However, the order of pigment deposit on the final image receptor impacts the qualitative perception of imperfections in the color reproduction or printing process which results from imperfections in the toner transfer mechanisms used in the print engine.

Since yellow, magenta, and cyan are the conventional order of development in conventional single transfer full color electrophotographic print engines, the pigments appear on the paper in the same order, i.e. yellow closest to the paper, followed by magenta, with cyan on top.

The preferred embodiment of the present invention develops the colors in the same order but is a double transfer system, and thus the order in which the pigments appear on paper 35 is reversed from that which is normally encountered. Thus, as shown on FIG. 5B, in the preferred embodiment toner pigments are deposited on the paper in the order cyan, magenta, with yellow on top.

To understand the advantage of pigment order, consider the electric field components shown in FIG. 5B. The toner portion of the total electric field $E_t$ is the linear combination of the electric field across each of toner layers 88 through 90, $E_y$, $E_m$, and $E_c$, respectively. The toner deposits 88 through 90 each consist of collections of plastic materials having triboelectric charges of the same polarity thereon. Therefore, there are significant repulsion forces tending to push toner layers 88 and 89 away from toner layer 90. It will be immediately appreciated that toner layer 88 is under the combined influence of the repulsive forces from the positive charges within toner layers 89 and 90. Therefore, at composite image transfer station 32 yellow toner layer 88 is being repulsed by the positively charged layers 89 and 90 and thus, if the triboelectric charge characteristics tend to be equal, is the most likely candidate to fail to transfer to paper 35 with maximum efficiency.

By selecting yellow as the upper toner pigment with respect to the image which gets transferred to the final print receptor, the following benefits are obtained. First, it should be understood that yellow may be properly characterized as the pigment which is hardest to see among the three pigments normally used in color electrophotography. The first main advantage from this selection of pigment order is the spectral characteristic of imperfections in the transfer for highly saturated areas, such as the process black area illustrated in FIG. 5B. When less yellow pigment than is desired ultimately gets transferred to the final print receptor, the flawed areas where the yellow pigment transfer was incomplete tend toward blue. Therefore, the absence of complete transfer of yellow moves the spectrum of a saturated area from process black toward a dark blue. If yellow and cyan are reversed, the absence of complete transfer of cyan would move the spectrum of a saturated area from process black toward a red or yellow hue.

As shown in FIGS. 1 and 2, roller 26 is maintained at a ground potential through a connection to ground shown as conductor 60. This assists in discharge of belt 20 and paper 35 as they pass roller 26 on the way to the machine's fuser (not shown). Successful discharge of paper 35 assists in preventing the paper from adhering to belt 20 as the belt makes its turn around roller 26.

The grounding of roller 26 assists in dissipating residual charge on paper 35 and belt 20 as they pass and which also prevents paper 35 from adhering to belt 20 as it goes around roller 26. This helps prevent paper jams at the transfer belt/fuser junction.

Additionally, it should be noted that the grounding of roller 26 helps maintain the uniformity of the electric field at the toner/transfer belt junction at transfer station 32. Again, reference is made to FIG. 5A in which the electric field within belt 20 is shown as pointing from the toner/transfer belt junction toward grounded plate 36. Those skilled in the art will understand that the construction of the device shown in FIG. 1 puts a large conductive surface, in the form of roller 26, also at ground potential disposed at the down stream side of transfer belt 20. Thus, there is a similar E field within the belt pointing in the direction from transfer station 32 towards roller 26. This tends to establish symmetry of the E field within the transfer belt at the boundaries of transfer station 32. While the foregoing is not believed necessary by the inventors of the present invention, it is believed that it is an additional benefit which is obtained from providing a good conductive path to ground through roller 26.

As noted in the Summary of the Invention, it is the bulk resistivity, having the dimensions of resistance times length, which creates the tendency of the charges on belt 20 to dissipate when belt 20 contacts grounded surfaces such as roller 26, like the discharge of a capacitor, due to the partial conductivity of belt 20. In the preferred embodiment of the present invention, belt 20 is constructed of materials having a bulk resistivity which falls in the range of $10^7$ to $10^{10}$ ohm centimeters. Bulk resistivity is principally responsible for controlling the ability of charge induced on the outer surface of belt 20 to flow through the belt and be appropriately discharged to ground through conductor 60.

Also, as noted hereinabove, it is primarily a coincidence that the numerical values of the preferred ranges of surface and bulk resistivities are identical in the preferred embodiment. While there is certainly a relationship between the two, it is both possible and reasonably common to construct belts having surface and bulk resistivity characteristics which differ substantially when the first is expressed in ohms and the latter is expressed in ohm centimeters. It is important in constructing preferred forms of the present invention to select the bulk resistivity characteristic for the material of belt 20 such that it will discharge substantially 90 percent of the surface charge induced thereon during one revolution of the belt.

Figure 6:
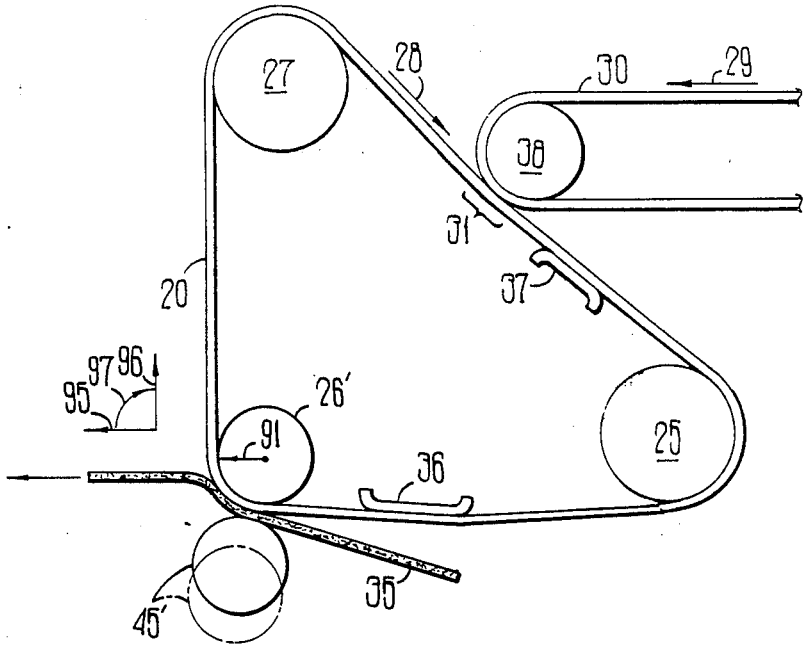
FIG. 6 is a side elevational cross section of an alternate preferred embodiment of the transfer stations of FIG. 1.

Turning next to FIG. 6, an alternate embodiment of the present invention is illustrated in which a moveable roller 45' is selectively moved into and out of a position in which it contacts transfer belt 20 opposite a roller 26', which corresponds to roller 26 shown in the previous embodiment. The particular electrical connections are not shown on the corresponding elements of FIG. 6 but it should be understood that they are identical to those shown in FIG. 1. Thus, plate 36 and roller 26' are grounded, roller 45' has a negative transfer potential applied thereto, etc. As shown in FIG. 6, it is preferred to make roller 26' a passive roller and of smaller diameter than rollers 25 and 27. Note that the embodiment of FIG. 6 is one in which the advantage of wide nip area to the transfer station which results in the use of rubber coating 59 in the previous embodiment is forsaken in favor of reduced expense and simplicity. As the diameter of roller 26' is reduced, there is a corresponding reduction in radius of curvature 91 for the path belt 20 takes around roller 26'. The smaller this radius of curvature, the more paper 35 will tend to peel away from belt 20 and prevent jams at the transfer station to fuser junction of the paper path.

It is the belief of the inventors of the present invention that a rubber coated roller may also be used at the position of 26' and that the loss of benefits from grounding this roller may be offset by the benefits of increasing the length of the transfer station. If the roller is sufficiently small, the tendency of the paper to peel away from the belt, even in the presence of considerable residual static charge, should prevent paper jams. The use of a three point suspension system for transfer belt 20 also provides the advantage of allowing the length of the transfer station to be increased and at the same time providing a relatively sharp turn at the point at which the paper 35 is to be detached from belt 20.

Illustrated in FIG. 6 is the relationship between the direction of travel of belt 20 as it approaches the transfer station, indicated by arrow 95, and the direction the belt travels as it leaves the transfer station and passes around roller 26', indicated by arrow 96. The angle drawn between a vector representing the direction of travel during approach to the transfer station and the direction of travel as the belt exits the transfer station and rounds a roller thereat is shown as 97, and is defined in this specification to be the approach to exit angle. Bond papers commonly used in electrophotographic engines in western countries will tend to reliably peel away from the transfer belt.

The advantage of an additional wrap, thus increasing dwell time in a transfer zone, is obtained at transfer station 31 by the relative positioning of rollers 25, 27 and 38 so that there is a wrap or overlap creating a long transfer zone 31 at the PC belt to transfer belt interface. This general principle was previously disclosed in FIG. 6, and the discussion thereof, in U.S. Pat. No. 4,697,920 to Palm et al.

At the photoreceptor to transfer belt transfer station 31, the same principles described hereinabove with respect to the electric field component within belt 20 at transfer station 32, apply. The polarity is reversed in that voltage source 50 which is connected to plate 37 places a negative voltage on the inside of the transfer belt with respect to the grounded photoconductor roller 38. However, the advantages obtained from use of a belt having a surface resistivity within the range recited in this specification all manifest themselves at transfer station 31, as well as transfer station 32.

Additionally, it should be noted that because these advantages manifest themselves at both transfer stations, the principles described and claimed herein are equally applicable to double transfer systems such as the system disclosed in the preferred embodiment, and a single transfer system in which belt 20 was used, with an appropriate paper retaining mechanism such as a vacuum plenum, to retain a sheet of image receptor as it moves about the path traveled by belt 20 to make multiple passes by photoreceptor 30. Thus, the fact that in the preferred embodiment belt 20 is an intermediate transfer belt should not disguise its nature as an image receiving web, as defined herein, which could also be used to carry a web of a final image receptor such as a sheet of paper.

The advantages to be obtained from selection of triboelectric charge characteristics for the toner materials used in the preferred embodiment will now be described in connection with FIGS. 7A and 7B. As described hereinabove, the transfer voltage applied by source 50 is stepped according to the particular one of the developed images being transferred from photoreceptor 30 to transfer belt 20, i.e. whether it is the first, second, or third image.

As described hereinabove, the stepped transfer voltages take values of −250, −325, and −400 for the yellow, magenta, and cyan toners, respectively. This is to overcome the effects of previously transferred toner layers when the second and third toners are transferred from photoconductor belt 30. The stepped voltages, combined with the use of predischarge lamp 42, have been found to substantially eliminate back transfer problems in the preferred embodiment.

As noted in the Background of the Invention section, the inventors of the present invention have discovered that they believe the teaching of U.S. Pat. No. 4,093,457 to Hauser et al. (assigned to Xerox Corporation) is exactly the opposite of what can be combined with the above described mechanisms to produce optimum forward transfer characteristics in a color electrophotographic print engine. Hauser teaches sequentially increasing the triboelectric charge characteristics of the toners used in developing sequential separated images. It is Hauser's teaching that this helps eliminate back transfer.

The inventors of the present invention believe that the use of predischarging, such as that embodied by predischarge lamp 42 and its controlled voltage source 41, together with the stepping of the transfer field applied by voltage source 50 substantially overcomes the back transfer problem. Thus, the present inventors believe that stepping of triboelectric charge may be most advantageously used to prevent commonly encountered problems of getting forward transfer to take place in the first place in color electrophotographic print engines. Tests of this theory show that sequentially increasing the triboelectric charge of the toner materials produces improved forward transfer characteristics without exacerbating back transfer as taught by Hauser.

The principles which the present inventors believe are involved are illustrated in connection with FIGS. 7A and 7B. FIG. 7A represents the electric field conditions as photoreceptor belt 30 approaches transfer belt 20 at the entrance to transfer station 31.

As described in the Background of the Invention, it is an often difficult to achieve design goal in creating color electrophotographic print engines to apply a uniform electrostatic attraction between each toner image developed on the photoconductor belt and the image receiving web to which the image is to be transferred. The primary problem is overcoming the effects of previously transferred toner materials, as well as boundaries in the charged and discharged areas of the photoconductor itself. In FIG. 7A arrow 110 represents the applied electric field resulting from the potential difference between plate 37 and the ground potential of roller 38. Arrow 111 represents the force per unit mass that the applied E field exerts on toner materials 88 on photoconductor belt 30.

Figure 7A:
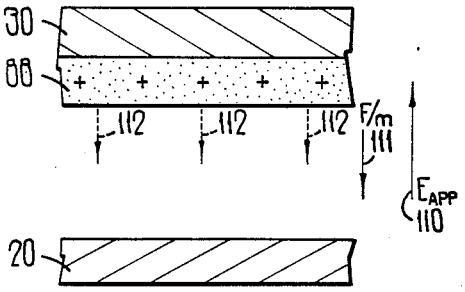
FIG. 7A is a diagrammatic representation of the electric fields at the separated image transfer station during transfer of the first developed separated image.
Figure 7B:
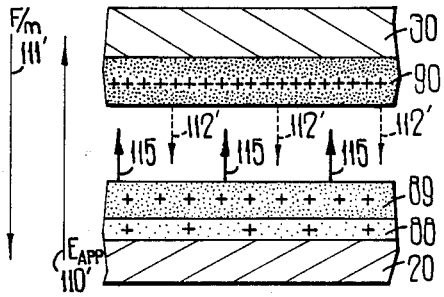
FIG. 7B is a diagrammatic representation of the electric fields at the separated image transfer station during transfer of the third developed image.

For comparison's sake, it should be noted that in FIG. 7B, arrow 110' represents the magnitude of the applied electric field between plate 37 and roller 38 and arrow 111' represents the force per unit mass, resulting solely from the applied E field, on toner particles 90 which are attached to photoreceptor belt 30. Again, the precise lengths of these arrows are not intended to be quantitatively precise, but to qualitatively represent the relationship between the two conditions. The density of the plus signs ("+") shown in toner elements 88, 89, and 90 in FIGS. 7A and 7B represent the relative triboelectric charge characteristics among the yellow, magenta, and cyan toners, respectively. Therefore, in FIG. 7B, arrows 110' and 111' are shown as being of equal length whereas arrow 111 is shorter than arrow 110 in FIG. 7A. This indicates that for a specified value of the applied E field, the force per unit mass on the toner particles which results solely from the contribution of the applied E field, is proportional to the triboelectric charge characteristics for those particular toner materials. Thus, the relative length of arrow 111 as compared to arrow 110 is less than arrow 111' as compared to arrow 110', for the respective cases illustrating the forces on toner particles 88 and toner particles 90. Since toner particles 88 have a lower triboelectric charge, a given applied E field exerts less force per unit mass on these particles.

In FIG. 7A, arrows 112 represent the resultant force per unit mass on the particles of toner material 88 as a result of applied E field 110. Note that arrow 111 and arrow 112 are of substantially equal length. This is because, for the transfer of the first developed image consisting of toner materials 88, the applied E field represented by arrow 110 makes substantially the only contribution to the force. Note that for purposes of discussion of FIGS. 7A and 7B, any residual attraction between transfer belt 30 and the toner materials lying thereon is not taken into account. So long as predischarging of photoreceptor belt, as described hereinabove, is accomplished in a satisfactory manner, it is appropriate to ignore any such attraction in describing this model for use of stepped triboelectric charge characteristics.

FIG. 7B represents the forces on cyan toner particles 90 during the transfer of the last developed separated image from photoreceptor 30 to transfer belt 20. Arrows 115 represent the repulsive force per unit mass exerted on toner particles 90 by the previously transferred toner particles 88 and 89. Since all of the triboelectric charges are of like polarity, previously transferred toner layers 88 and 89 tend to repel the charges on toner particles 90. However, in the situation illustrated in FIG. 7B applied E field 110 is greater, and the force per unit mass on toner particles 90 resulting from the applied E field, shown as 111', is also greater. Therefore, arrows 112' represent the net force per unit mass exerted on toner particles 90 which results from the applied E field represented at 110' and the electrostatic repulsion forces from the previously transferred toner layers represented by arrows 115.

The increase in attractive force per unit mass is a result of the contribution of the increased applied electric field on the last toner layer and the fact that it has the highest triboelectric charge density. These parameters are selected to offset repulsive forces 115 and to thereby generate forces tending to transfer the toner particles 90 from the last image which are substantially identical to those on toner particles 88 during transfer of the first image (FIG. 7A). The electrostatic repulsion forces represented by arrows 115 in FIG. 7B are kept to a practical minimum because of the lower triboelectric charge characteristic of toners 88 and 89. In the print engine described in the Hauser patent, the first transferred images in the positions corresponding to those of toners 88 and 89 in FIG. 7B are of the highest triboelectric charge. Thus, while boundary areas on photoreceptor 30 will tend to produce less attraction back to the photoreceptor on these charges, due to their strong tendency to adhere to the image receiving web under the influence of an applied electric field, a strong triboelectric charge concentration in this position increases the repulsion forces on the subsequently transferred toner materials. It is believed by the inventors of the present invention that this reduces effective forward transfer in the first place, leading to poor performance.

In the preferred embodiment of the present invention, the stepping of the average triboelectric charge characteristics for the toners is given according to the following table.

| Toner Sequence | Toner Pigment | Average Triboelectric Charge (microcoulombs per gram) |
|---|---|---|
| 1 | yellow | 8–10 |
| 2 | magenta | 10–12 |
| 3 | cyan | 10–14 |

As noted hereinabove, the entire 8 to 14 microcoulombs per gram range which encompasses all three toner materials used in the preferred embodiment is lower than what the prior art teaches is appropriate for providing good forward transfer characteristics. It should also be noted that modest steps, both proportionately and in absolute values of microcoulombs per gram, have been found by the present inventors to produce the advantageous results described herein.

It should be noted that other color electrophotographic print engines typically use toners with triboelectric charge characteristics falling in the range of 15 to 25 microcoulombs per gram. Only the last transferred toner described in Hauser, having a characteristic of 6 microcoulombs per gram, falling within the preferred range of the present invention. Additionally, Hauser's described preferred values for stepped charges include a seven fold decrease between the first toner and the last toner, going from 44 microcoulombs per gram to 6.

While Hauser's invention may help reduce back transfer in the type of machine described in his application, the inventors of the present invention have discovered that the order and range of stepped charges described in Hauser makes it very difficult to get an effective pull on the last layer to be transferred, due to both its very low triboelectric charge, thus reducing the force per unit mass from the applied electric field, as well as the greatly increased repulsive forces from the first two layers transferred. Thus, for Hauser's device to achieve good forward transfer, high applied fields must be used with the problems which typically result therefrom.

Next, the advantages of the use of more conductive developer materials in the preferred embodiment will be discussed in connection with FIGS. 8 through 10.

Figure 8:
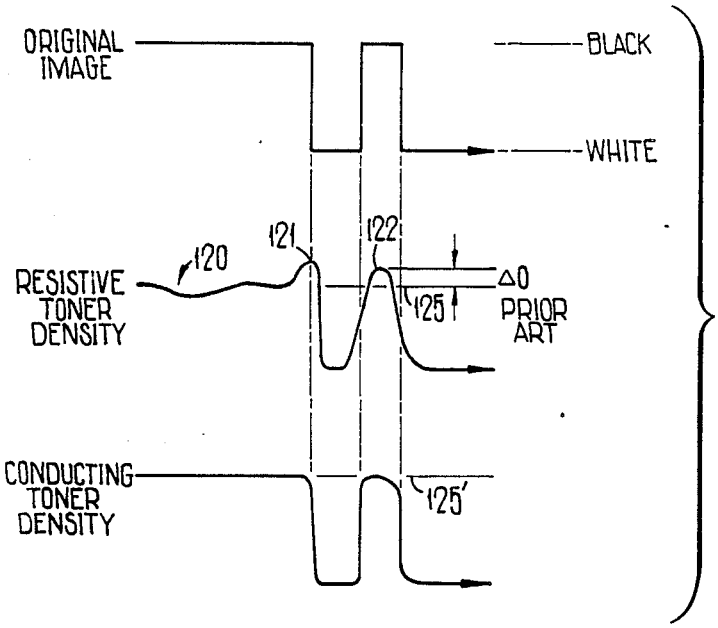
FIG. 8 is a composite diagram representing photoreceptor electrostatic potentials and developed image toner densities at image boundaries for both the prior art and the preferred embodiment.

FIG. 8 is a combined voltage and toner density diagram illustrating toner development along image boundaries. The top line of FIG. 8 represents the magnitude of the charging voltage on the photoreceptor belt at sharp image boundaries which result from exposure of such an image segment in a copying machine or laser printing device. Note that with positively charged toner materials of the type used in the preferred embodiment, the highest level shown in the top line would in fact be the most negative. However, it is useful to think in terms of the magnitude of the voltage tending to attract toner particles.

The middle line of FIG. 8 represents the density of the deposited toner using prior art resistive developer materials when the latent image portion represented in the top line is developed. Note that for the extended highly saturated area shown at 120 there is a substantially constant toner density, although it varies to some degree. Near the boundaries, there is an increase in toner density shown at 121 in FIG. 8. Similarly, an increase in the density occurs near the relatively fine line of the image segment shown at 122 in FIG. 8. The difference between toner density for the broad fill saturated areas shown at 120 and the boundary edges shown at 121 and 122 is shown as $\Delta$ D in FIG. 8, and represents the increased density at the boundary condition over the density for the filled area represented by dashed line 125.

The bottom line of FIG. 8 represents deposited toner density in developing the same image segment using toner materials having a bulk resistivity in the preferred range of $1\times10^9$ to $5\times10^9$ ohm-centimeters in the preferred embodiment. There is a slight rounding of the boundary characteristics, but there is no increase in border density corresponding to areas 121 and 122 of the density shown for the prior art. Thus, even on the fine line shown in the latent image, the maximum toner density is substantially the same as the toner density for the filled area, as illustrated by line 125'.

The phenomena represented by FIG. 8 is known in the prior art. As noted hereinabove, the conventional wisdom of the prior art is that the use of resistive developer materials to increase deposited density at the boundaries gives sharp looking edges. However, as noted above in the Background of the Invention section of this specification, it is believed by the inventors of the present invention that the use of resistive developer materials in color electrophotographic print engines explains the primary mechanism for halo problems.

Figure 9:
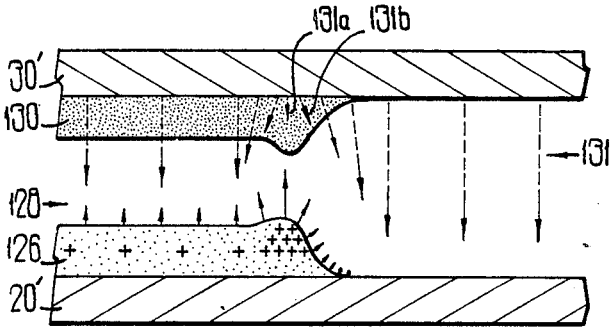
PRIOR ART FIG 9
FIG. 9 is a diagrammatic representation of the field gradients for transfer of a developed image onto a previously transferred developed image in a prior art color electrophotographic print engine.
Figure 10:
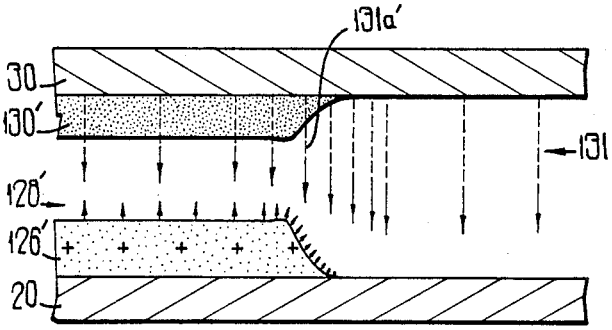
FIG. 10 is a diagrammatic representation of the field gradients for a similar transfer in the preferred embodiment.

FIGS. 9 and 10 represent the inventors' belief as to the mechanism at work in the prior art and why the use of slightly more conductive materials in the preferred embodiment has been found to significantly reduce halo in full color electrophotography. FIG. 9 represents the circumstances in a prior art color electrophotographic machine wherein the second developed separated image is about to be transferred on top of the first between a photoreceptor 30' and an image receiving web 20'. Consider for a moment what has happened in the prior art when the first image was developed. The first toner materials shown as 126 in FIG. 9 exhibited the characteristic hump in deposited toner density at the image boundary. This is shown as substantially flattened in the previously transferred image illustrated in FIG. 9 due to the compression between photoreceptor 30' and image receiving web 20' which occurred as toner materials 126 moved through the transfer station. However, irrespective of the extent to which the boundary area of toner materials 126 were physically compressed, there is a higher charge density at the boundary as illustrated at 127. The arrows emanating from toner materials 126, shown generally at 128 in FIG. 9, represent the electrostatic forces tending to repel toner materials 130 as a result of the charge characteristics of previously transferred image 126. Therefore, arrows 128 increase in magnitude around the area 127 of increased charge density. The increase in charge at area 127 results from the fact that the density of toner materials at the boundary was increased (as illustrated in FIG. 8) and the fact that the toner material 126 is highly resistive. Therefore, this local maxima of charge cannot effectively dissipate during the time between successive transfers of separated images. The dotted arrows pointed downward in FIG. 9, indicated generally at 131, represent the electrostatic forces by their lengths, and the electric field gradient by their orientations, of the field which results from the applied electric field between image receiving web 20' and photoreceptor 30', and the contributions (represented by arrows 128) from the already transferred charged materials lying on web 20'.

It should be noted that there are two important aspects of the variation in the electric field gradient illustrated by arrows 131 as one moves from the dense area of the image on the left hand side of FIG. 9 toward the image boundary on the right. First, the minimum magnitude of the field gradient, illustrated by arrow **131*a*, occurs at the boundary itself. Therefore, the least force tending to attract toner materials 130 down toward image receiving web 20' occurs at the image boundary where consistent forward transfer is extremely important to the perceived quality of the resultant color image. Secondly, the maximum rotation of the field gradient occurs just outside the boundary, as illustrated by gradient vector 131*b*. As one proceeds toward the right of FIG. 9 the field gradient again straightens out and is perpendicular to photoreceptor 30' and image receiving web 20'. It is well known that charged particles will follow the field gradient when moving through an electrostatic field. Thus, the tendency in the prior art is for toner particles, particularly those represented in the excess of toner particles near the boundary for developed image 130, to move in the direction of gradient vector 131*b* and thus fall outside the boundary of the previously developed image 126**. This causes significant halo to appear in the resultant developed image.

FIG. 10 illustrates what the inventors believe to be the circumstances prevailing in the preferred embodiments in which toner materials having a conductivity falling within the above recited range are used. The first transferred image is shown as 126' and the second transferred image is shown as 130'. The electric field repulsive forces from previously transferred image 126' are indicated at 128'. First, it should be noted that the plus signs within developed image 126' indicate a substantially uniform charge per unit volume characteristic for the first transferred image. This results from two phenomena in the preferred embodiment. The first is the fact that the use of the conductive developer materials does not create increased deposited toner density at boundary areas when the image is originally developed on the photoreceptor, as illustrated by the bottom line of FIG. 8. Secondly, even if there is a slight increase in the density of toner materials at the boundary, the conductivity of toner materials 126' is sufficient to allow any locally accumulated maxima of charge to dissipate and spread through the image during the time between transfers. Thus, arrows 128' in FIG. 10 are shown as being of substantially equal length until one reaches the extremes of the boundary area where the charge per unit volume drops off. Therefore, there is no increase in the electrostatic repulsion forces represented by arrows 128' at the boundary.

It will therefore be appreciated that arrows 131', which again represent both the strength of the electrostatic attraction, through their length, and the field gradient, through their orientation, indicate that there is no substantial diminution in the attractive force at the boundary of the second developed image 131. Again, maximum rotation of the field gradient occurs at the boundary as illustrated by arrow 131*a'*. However, in the preferred embodiment, the rotation of the field gradient is less. Therefore, there tends to be a good uniform transfer of materials from second image 130' on top of first image 126' at the boundary area. This significantly reduces the halo problems encountered in the prior art.

In passing, it should also be noted that the use of stepwise increasing triboelectric charge characteristics help prevent halo problems which would be exacerbated by the stepped triboelectric charge characteristics of the device disclosed in U.S. Pat. No. 4,093,457 to Hauser. If one considers the situation in FIG. 9 in connection with Hauser's use of a very high triboelectric charge characteristic for the first image, it will be appreciated that the repulsive forces from an increase in toner density in area 127 will be particularly strong for the first image transferred to web 20'. The physical concentration of materials having a very high triboelectric charge will tend to exacerbate the rotation of the field gradient, thus assuring that a substantial portion of the toner at the boundary region of the second developed image will fall outside the true image boundary, thus exacerbating the halo phenomenon.

Lastly, as noted hereinabove, the present invention is useful in any machine using an electrophotographic print engine having an appropriate image signal source which can determine particular pixel areas having significantly saturated dark colors, particularly those tending toward black. It is within the scope of the present invention to use only black materials to develop these regions as well as to overlay combinations of the three process toners tending to produce process black with a monochromatic black toner. It should be noted that the phrase overlay used in the above statement refers to the resultant order of toners which appears on the paper and thus black, as noted hereinabove, will be the first toner material laid down on transfer belt 20. Therefore, if reference is made to FIG. 5B the black toner materials will lie above yellow toner materials 88 illustrated thereon.

In connection with this, the black materials can be most efficiently transferred as the first image to leave photoreceptor belt 30 onto transfer belt 20 since there is no way to practically diminish the photoreceptor's hold on the materials through the use of predischarge lamp 42 (FIG. 1). However, since black will be the first image laid down, it is assured that at least the surface of transfer belt 20 will present a uniform charge per unit area characteristic to the black image.

Again, considering for a moment the circumstances at transfer belt to image receptor transfer station 32, as illustrated in FIG. 5A, the black toner materials, being the first to be laid on the transfer belt 20 will be on top of the ultimate image which appears on paper 35. As noted above, it is the developed image closest to transfer belt 20 which is the most difficult to transfer. However, in a four color process slightly inconsistent forward transfer of the black toner materials from transfer belt 20 onto image receptor 35 will do minimum harm since the other three toner materials are available to generate processed black when fused. Thus, the failure to uniformly make a forward transfer of the material closest to transfer belt 20 only results in very modest variations in the saturation of the dark areas of a final image making use of the black materials, and does not lead to a spectral distortion.

As noted hereinabove, the present invention can, in many ways, be properly characterized as a selection of all of the foregoing important parameters so that the transfer mechanisms in electrophotographic print engine cooperate in the best way possible to produce a very high quality final image having good uniformity of color and saturation in highly saturated image areas, minimum halo at the boundaries between saturated areas and light areas of the image, minimum back transfer, and efficient uniform forward transfer during the development process. Many of the teachings and inventive aspects embodied in transfer station 32 are equally applicable to single transfer machines where transfer is made directly from a photoreceptor to a final image receptor. Naturally, in such a machine it is preferable to reverse the order of development of pigments so that the yellow pigment (in a three color system) remains the top pigment on the final image receptor. The present inventors have set forth several physical models which they believe properly explain the phenomenon creating problems in the prior art. It is not the intent of this specification to state that these models are rigorously correct, but the inventors believe they are appropriate descriptions of the phenomenon which take place. The information gained from the use of these models has been used in creating the present invention and, it performs in accordance with the theory represented by the models, at least in the significantly improved color image results obtained.

In view of the foregoing descriptions of embodiments of the present invention many alternate embodiments and modifications thereto will suggest themselves to those skilled in the art and therefore the scope of the present invention should be limited only by the claims below.

We claim:

1. An improved transfer mechanism for use in an electrophotographic print engine comprising in combination:

a web for carrying a developed toner image thereon, said web being characterized by a surface resistivity in the range of $10^7$ to $10^{10}$ ohms per square;

a first roller disposed on a first side of said web at a transfer station;

a second roller disposed on a second side of said web, said second side being opposite said first side;

roller control means for selectively moving said second roller between a first position at which said second roller contacts said web and urges same against said first roller and a second position at which said second roller does not contact said web;

a grounding plate disposed away from said transfer station along a direction of travel of said web and in contact with said web;

potential control means for maintaining said grounding plate at a first predetermined electrical potential with respect to a predetermined reference potential and for maintaining said second roller at a second predetermined electrical potential with respect to said predetermined reference potential when said second roller is in said first position; and transfer control means for detecting when said developed toner image is approaching said transfer station and for placing an image receptor between said first and second rollers and causing said roller control means to move said second roller to said first position in response thereto.

2. An improved transfer mechanism as recited in claim 1 wherein the magnitude of the difference between said first predetermined potential and said second predetermined potential is in the range of six hundred to two thousand volts.

3. An improved transfer mechanism as recited in claim 1 wherein said potential control means further maintains said second roller at a third predetermined electrical potential in response to said second roller moving to said second position.

4. An improved transfer mechanism as recited in claim 3 wherein said first predetermined electrical potential and said third predetermined electrical potential are the same.

5. An improved transfer mechanism as recited in claim 1 wherein said potential control means comprises a power supply having an output at said second predetermined electrical potential connected to a brush and further comprising means for holding said brush in contact with said second roller.

6. An improved transfer mechanism as recited in claim 5 wherein said potential control means turns off said power supply in response to said roller control means moving said second roller to said second position.

7. An improved transfer mechanism as recited in claim 6 wherein said brush is a first brush, and wherein said potential control means further comprises a second brush electrically connected to a source of said first predetermined electrical potential and said second brush is disposed so that it electrically contacts said second roller when said second roller is in said second position.

8. An improved transfer mechanism as recited in claim 1 wherein said grounding plate contacts said web on said first side of said web.

9. An improved transfer mechanism as recited in claim 1 wherein said first roller is coated with a layer of deformable material.

10. An improved transfer mechanism as recited in claim 1 further comprising a cleaning station for said second roller located so that said second roller contacts said cleaning station when it is in said second position.

11. An improved transfer mechanism as recited in claim 10 further comprising:

roller driving means for engaging and rotating said second roller when same is in said second position;

and wherein said cleaning station comprises a collection tray and a cleaning blade, said cleaning blade being disposed so that it contacts said second roller when said second roller is in said second position;

whereby said second roller is cleaned by said cleaning blade in response to rotation of said second roller by said roller driving means when said second roller is in said second position.

12. An improved transfer mechanism as recited in claim 11 wherein said cleaning blade is integrally formed with said collection tray by one edge of a toner receiving opening in said collection tray.

13. An improved transfer mechanism as recited in claim 1 wherein:

said web wraps around said first roller at said transfer station with an approach-to-exit angle greater than sixty degrees.

14. An improved transfer mechanism for use in an electrophotographic print engine comprising in combination:

a web for carrying a developed toner image thereon;

a first roller disposed on a first side of said web at a transfer station;

a second roller disposed on a second side of said web, said second side being opposite said first side;

roller control means for selectively moving said second roller between a first position at which said second roller contacts said web and urges same against said first roller and a second position at which said second roller does not contact said web;

transfer control means for detecting when said developed toner image is approaching said transfer station and for placing an image receptor between said first and second rollers and causing said roller control means to move said second roller to said first position in response thereto;

means for applying an electric field between said developed toner image and said image receptor when said image receptor is at said transfer station thereby causing said developed toner image to electrostatically adhere to said image receptor;

roller driving means for engaging and rotating said second roller when same is in said second position; and a cleaning station comprising a collection tray and a cleaning blade, said cleaning blade being disposed so that it contacts said second roller when said second roller is in said second position; whereby said second roller is cleaned by said cleaning blade in response to rotation of said second roller by said roller driving means when said second roller is in said second position.

15. An improved transfer mechanism as recited in claim 14 wherein said cleaning blade is integrally formed with said collection tray by one edge of a toner receiving opening in said collection tray.

16. An improved transfer mechanism for use in an electrophotographic print engine comprising in combination:

a developed image carrying medium having an inner surface and an outer surface for carrying a developed toner image along an arcuate path at a transfer station;

a supporting belt for carrying an image receiving belt thereon to which said developed toner image is to be transferred, said belt being characterized by a surface resistivity in the range of $10^7$ to $10^{10}$ ohms per square and a volume resistivity in the range of $10^7$ to $10^{10}$ ohm-centimeters;

means for driving said supporting belt past said transfer station so that said image receiving belt contacts said outer surface over a predetermined wrap length of said arcuate path;

a first electrode in contact with said inner surface of said developed image carrying medium;

a second electrode disposed away from said transfer station and away from said first electrode along a direction of travel of said supporting belt and in contact with said supporting belt; and potential control means for maintaining said first electrode at a first predetermined electrical potential with respect to a predetermined reference potential and for maintaining said second electrode at a second predetermined electrical potential with respect to said predetermined reference potential when a developed image on said image receiving belt is at said transfer station.

17. An improved transfer mechanism as recited in claim 16 wherein the magnitude of the difference between said first predetermined potential and said second predetermined potential is in the range of six hundred to two thousand volts.

18. An improved transfer mechanism as recited in claim 16 wherein the magnitude of the difference between said first predetermined potential and said second predetermined potential is in the range of two hundred fifty to four hundred fifty volts.

19. An improved transfer mechanism as recited in claim 16 wherein the magnitude of the difference between said first predetermined potential and said second predetermined potential is in the range of two hundred fifty to two thousand five hundred volts.

20. An improved transfer mechanism as recited in claim 16 wherein said first predetermined potential is ground potential.

21. An improved transfer mechanism as recited in claim 16 wherein:

said developed image carrying medium is a photoreceptor.

22. An improved transfer mechanism as recited in claim 16 wherein:

said developed image carrying medium is a photoreceptor belt and said first electrode comprises a roller around which said photoreceptor belt travels to form said arcuate path.

23. An improved transfer mechanism as recited in claim 16 wherein:

said second electrode is a metallic plate.

24. An improved transfer mechanism as recited in claim 16 wherein:

said second electrode is disposed in contact with said supporting belt on a side of said supporting belt opposite the side of said supporting belt nearer to said outer surface.

25. An improved transfer mechanism for use in an electrophotographic print engine comprising in combination:

a belt for carrying a developed toner image thereon, a first roller disposed on a first side of said belt at a transfer station;

a second roller disposed on a second side of said belt, said second side being opposite said first side;

roller control means for selectively moving said second roller between a first position at which said second roller contacts said belt and urges same against said first roller and a second position at which said second roller does not contact said belt;

transfer control means for detecting when said developed toner image is approaching said transfer station and for placing an image receptor between said first and second rollers and causing said roller control means to move said second roller to said first position in response thereto;

roller driving means for engaging and rotating said second roller when same is in said second position; and a cleaning station for said second roller, located so that said second roller contacts said cleaning station when it is in said second position, comprising a collection tray and a cleaning blade, said cleaning blade being disposed so that it contacts said second roller when said second roller is in said second position;

whereby said second roller is cleaned by said cleaning blade in response to rotation of said second roller by said roller driving means when said second roller is in said second position.

26. An improved transfer mechanism as recited in claim 25 wherein:

said first roller is coated with a layer of deformable material.

27. An improved transfer mechanism as recited in claim 25 wherein:

said cleaning blade is integrally formed with said collection tray by one edge of a toner receiving opening in said collection tray.

28. An improved transfer mechanism for use in a color electrophotographic print engine comprising in combination:

a developed image carrying medium having an inner surface and an outer surface for carrying, one at a time, a plurality of separated developed toner images along an arcuate path at a transfer station, each of said developed toner images comprising one member of a set of predetermined toners;

a supporting belt for carrying an image receiving web thereon to which said developed toner images are to be sequentially transferred, said belt being characterized by a surface resistivity in the range of $10^7$ to $10^{10}$ ohms per square and a volume resistivity in the range of $10^7$ to $10^{10}$ ohm-centimeters;

means for driving said supporting belt past said transfer station so that said image receiving web contacts said outer surface over a predetermined wrap length of said arcuate path;

a first electrode in contact with said inner surface of said developed image carrying medium at said transfer station, a second electrode disposed away from said transfer station along a direction of travel of said supporting belt and in contact with said supporting belt on a side of said supporting belt opposite the side of said supporting belt nearer to said outer surface;

drive means for moving said developed image carrying medium and said supporting belt relative to each other;

transfer control means connected to said drive means for detecting the relative positions of each of said developed separated images and said image receiving web as said developed image carrying medium and said supporting belt move relative to each other; and potential control means for establishing and controlling an electrostatic potential difference between said first and second electrodes, said potential control means being responsive to signals from said transfer control means to set said electrostatic potential difference to a first voltage value when the first of said plurality of developed toner images is at said transfer station and to subsequently set said electrostatic potential difference to successively increasing voltage values, each being greater than said first voltage value, as subsequent ones of said plurality of developed toner images arrive at said transfer station.

29. An improved transfer mechanism as recited in claim 28 wherein:

a first one of said successively increasing voltage values is at least fifty volts more than said first voltage value.

30. An improved transfer mechanism as recited in claim 28 wherein:

a first one of said successively increasing voltage values is at least fifty volts more than said first voltage value and each subsequent one of said successively increasing voltage values is at least fifty volts greater than an immediately preceding one of said successively increasing voltage values.

31. An improved transfer mechanism as recited in claim 28 wherein:

said first voltage value is substantially equal to two hundred fifty volts;

the first one of said successively increasing voltage values is substantially equal to three hundred twenty-five volts; and the second one of said successively increasing voltage values is substantially equal to four hundred volts.

32. An improved transfer mechanism as recited in claim 28 wherein:

said developed image carrying medium is a photoreceptor.

33. An improved transfer mechanism as recited in claim 28 wherein:

said developed image carrying medium is a photoreceptor belt and said first electrode comprises a roller around which said photoreceptor belt travels to form said arcuate path.

34. An improved transfer mechanism as recited in claim 28 wherein:

said second electrode is a conducting surface member.

35. An improved transfer mechanism for use in a color electrophotographic print engine comprising in combination:

a developed image carrying medium having an inner surface and an outer surface for carrying, one at a time, a plurality of separated developed toner images along an arcuate path at a transfer station, each of said developed toner images comprising one member of a set of predetermined toners;

a supporting belt for carrying an image receiving web thereon to which said developed toner images are to be sequentially transferred, said belt being characterized by a surface resistivity in the range of $10^7$ to $10^{10}$ ohms per square and a volume resistivity in the range of $10^7$ to $10^{10}$ ohms centimeters;

means for driving said supporting belt past said transfer station so that said image receiving web contacts said outer surface over a predetermined wrap length of said arcuate path;

a first electrode in contact with said inner surface of said developed image carrying medium at said transfer station, a second electrode disposed away from said transfer station along a direction of travel of said supporting belt and in contact with said supporting belt on a side of said supporting belt opposite the side of said supporting belt nearer to said outer surface;

drive means for moving said developed image carrying medium and said supporting belt relative to each other;

transfer control means connected to said drive means for detecting the relative positions of each of said developed separated images and said image receiving web as said developed image carrying medium and said supporting belt move relative to each other; and potential control means for establishing and controlling an electrostatic potential difference between said first and second electrodes, said potential control means being responsive to signals from said transfer control means to set said electrostatic potential difference to a first voltage value when the first of said plurality of developed toner images is at said transfer station and to set said electrostatic potential difference to a second voltage value, greater than said first voltage value, as a second one of said plurality of developed toner images arrive at said transfer station.

36. An improved transfer mechanism as recited in claim 35 wherein:

said developed image carrying medium is a photoreceptor.

37. An improved transfer mechanism as recited in claim 35 wherein:

said developed image carrying medium is a photoreceptor belt and said first electrode comprises a roller around which said photoreceptor belt travels to form said arcuate path.

38. An improved transfer mechanism as recited in claim 35 wherein:

said second electrode is a conducting surface member.

39. In a color electrophotographic print engine of the type including a photoconductor for sequentially exposing at an exposure station, developing and carrying a plurality of separated developed toner images to a transfer station at which each of said separated developed toner images is transferred to an image receiving member, each of said developed toner images being formed by one member of a set of predetermined toners, each member of said set of predetermined toners being characterized by a respective one of a plurality of predetermined absorptions, drive means for moving said photoconductor in a predetermined direction of travel, a photoconductor discharge lamp located between said exposure station and said transfer station with respect to said direction of travel of said photoconductor for providing light output illuminating said photoconductor, transfer control means connected to said drive means for detecting the relative positions of each of said developed separated images with respect to said transfer station as said photoconductor moves;

the improvement comprising:

intensity control means connected to said discharge lamp and to said transfer control means for varying the output of said discharge lamp to establish a plurality of luminous flux density output levels for said light output illuminating said photoconductor, each of said luminous flux density output levels corresponding to a respective one of said plurality of predetermined absorptions, and for selecting a particular one of said plurality of luminous flux density output levels in response to signals from said transfer control means indicating which particular one of said set of predetermined toners is present in said separated developed toner image which is at said transfer station.

40. The improvement recited in claim 39 wherein:

said intensity control means comprises a variable power supply connected to said discharge lamp and said transfer control means.

41. In a color electrophotographic print engine of the type including a photoconductor for sequentially exposing at an exposure station, developing, and carrying a plurality of separated developed toner images to a transfer station at which each of said separated developed toner images is transferred to an image receiving member, each of said developed toner images being formed sequentially by one of a first toner material, a second toner material, and a third toner material, each of said toner materials being characterized by a respective one of a plurality of predetermined triboelectric charge characteristics:

the improvement wherein:

each of said triboelectric charge characteristics is in the range of ten to twelve microcoulombs per gram;

the average triboelectric charge characteristic for said second toner material is greater than the average triboelectric charge characteristic for said first toner material; and the average triboelectric charge characteristic for said third toner material is greater than said average triboelectric charge characteristic for said second toner material.

42. In a color photographic print engine of the type including a photoconductor for sequentially exposing at an exposure station, developing, and carrying a plurality of separated developed toner images to a transfer station in which each of said separated developed toner images is transferred to an image receiving member, each of said developed toner images being formed sequentially by one of a first toner material, a second toner material, and a third toner material, each of said toner materials being characterized by a respective one of a plurality of predetermined triboelectric charge characteristics;

the improvement wherein:

the average triboelectric charge characteristic for said first toner material is in the range of 8 to 10 microcoulombs per gram;

the average triboelectric charge characteristic for said second toner material is in the range of 10 to 12 microcoulombs per gram and is greater than said average triboelectric charge characteristic for said first toner material; and the average triboelectric charge characteristic for said third toner material is in the range of 10 to 14 microcoulombs per gram and is greater than said average triboelectric charge characteristic for said second toner material.

43. An electrophotographic print engine as recited in claim 42 wherein said first toner material is of a yellow pigment.

44. A color electrophotographic print engine as recited in claim 43 wherein said second toner material is of a magenta pigment and said third toner material is of a cyan pigment.

45. In a color photographic print engine of the type including a photoconductor for sequentially exposing at an exposure station, developing, and carrying a plurality of separated developed toner images to a transfer station in which each of said separated developed toner images is transferred to an image receiving member, each of said developed toner images being formed sequentially by one of a first toner material, a second toner material, and a third toner material, each of said toner materials being characterized by a respective one of a plurality of predetermined triboelectric charge characteristics;

the improvement wherein:

the average triboelectric charge characteristic for said second toner material is greater than the average triboelectric charge characteristic for said first toner material; and the average triboelectric charge characteristic for said third toner material is greater than said average triboelectric charge characteristic for said second toner material.

* * * * *